US005730830A

United States Patent [19]

Hall

[11] Patent Number: 5,730,830

[45] Date of Patent: Mar. 24, 1998

[54] FIBER PANEL MANUFACTURING METHOD AND APPARATUS

[75] Inventor: Lorne D. Hall, Redding, Calif.

[73] Assignee: Haddonfield Management Co. Ltd., Calif.

[21] Appl. No.: 578,322

[22] Filed: Dec. 26, 1995

[51] Int. Cl.[6] ..... B02C 19/12

[52] U.S. Cl. ..... 156/468; 156/475; 156/511; 156/523; 156/578; 156/580; 241/101.01; 241/186.4; 241/224; 241/605

[58] Field of Search ..... 241/101.01, 186.2, 241/186.35, 186.4, 224, 605; 156/580, 583.1, 443, 459, 468, 475, 510, 511, 523, 578

[56] References Cited

U.S. PATENT DOCUMENTS

| | | | |
|---|---|---|---|
| 2,978,191 | 4/1961 | Kingery | 241/605 X |
| 4,003,502 | 1/1977 | Barcell | 241/224 X |
| 4,364,526 | 12/1982 | White | 241/186.4 |
| 4,381,082 | 4/1983 | Elliott et al. | 241/605 X |
| 4,412,659 | 11/1983 | Crawford et al. | 241/186.2 X |
| 4,448,361 | 5/1984 | Marcy | 241/186.4 X |
| 4,451,322 | 5/1984 | Dvorak | 156/461 |
| 4,485,976 | 12/1984 | White | 241/186.2 |
| 4,497,448 | 2/1985 | Joa et al. | 241/186.4 |
| 4,790,489 | 12/1988 | Paul | 241/605 X |
| 5,277,372 | 1/1994 | Paul et al. | 241/186.4 |
| 5,472,556 | 12/1995 | Sanko | 156/498 |

OTHER PUBLICATIONS

Brochure (6 pages) entitled Edney Distributing Company, Inc. dated Aug. 1, 1990.

Brochure (4 pages) entitled "Roto Grind", Burrows Enterprises, Inc.

*Primary Examiner*—James Sells

*Attorney, Agent, or Firm*—John Russell Uren

[57] ABSTRACT

Apparatus and method for forming structural panel members from fiber crop material such as rice, straw and the like. The fiber crop material is bailed into circular or rectangular bails which bails are placed in a debailer/shredder. The fiber material is cut to a predetermined length and conveyed pneumatically to a compression chamber. A ram compresses the fiber into a rectangular slot between upper and lower platen members. Paper is applied with glue to the upper and lower surfaces of the fiber and is folded up to cover the sides of the fiber. The glue is cured on a curing table and the fiber is severed in a cutting section into desired lengths.

17 Claims, 33 Drawing Sheets

FIG. 5
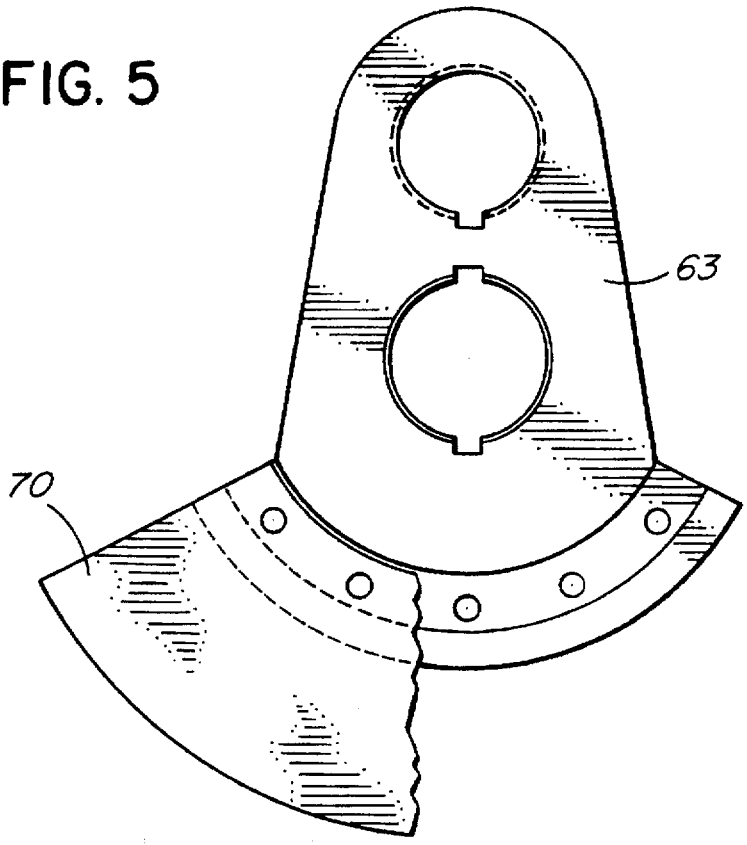
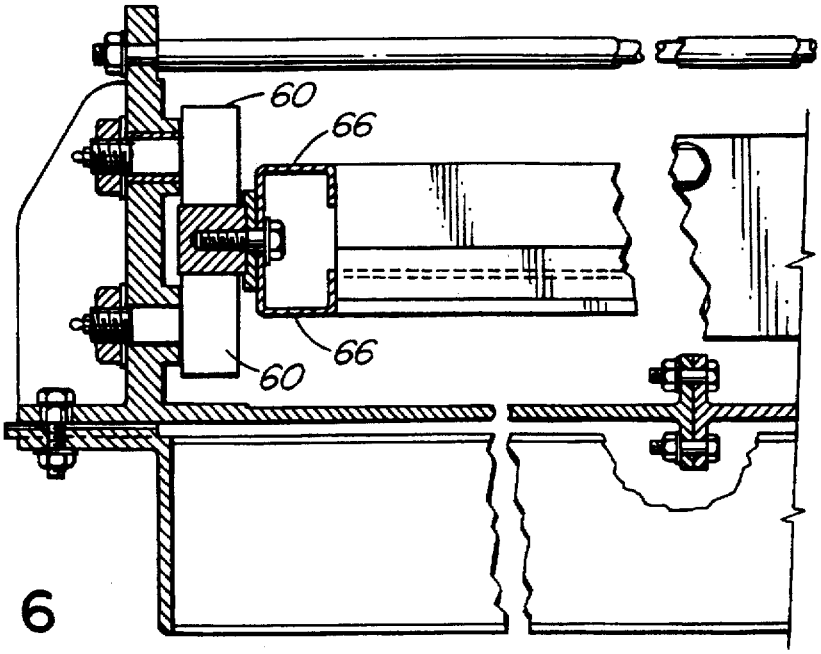
FIG. 6

15

FIBER PANEL MANUFACTURING METHOD AND APPARATUS

INTRODUCTION

This invention relates to a method and apparatus for the manufacture of wall material and, more particularly, for the manufacture of wall components or panel members from fiber material.

BACKGROUND OF THE INVENTION

The use of fiber material such as fibrous waste products from agricultural material, conveniently straw, to manufacture architectural material or wallpanels is known. Such techniques are disclosed, for example, in U.S. Pat. No. 4,451,322 (Dvorak) entitled APPARATUS FOR FORMING STRUCTURAL SHEETS FROM FIBROUS BIOLOGICAL WASTE. This patent teaches using waste products such as the residue from sugar cane and cereal grains crops. Such products are compressed into panels which can then be used for structural panels in building activities.

In the apparatus disclosed in the aforementioned '322 reference, there are numerous disadvantages. For example, the straw material is introduced into the apparatus by way of a hay bail off a forklift. The straw is manually separated from the bail and a conveyor introduces the separate fiber into the ram which creates the panel members by compression. The use of a conveyor does not enhance fiber separation since the various fibers lie clumped together as they are being transported. This is disadvantageous since it is desirable that the individual fibers be separated as much as possible prior to introduction into the ram in order to form a consistent panel.

A further disadvantage with the apparatus illustrated and described in the '322 patent is the position of the paper rolls which paper is used to surround the panel which is extruded with the ram. The paper rolls are positioned underneath the curing table with axes of rotation generally perpendicular to the longitudinal axis of the curing table. This restricts the size of the paper rolls to a non-standard one and requires inconvenient positioning of the paper rolls beneath the conveyor when used rolls are removed and new rolls are installed.

Yet another disadvantage of the '322 apparatus involves the use of electrical heating plates to cure the envelope surrounding the panels. The reciprocating nature of the machine will shake and vibrate the electrodes used for the electrical heating plates unless they are rigidly contained. The machine shaking may cause wire connection failures and electrode casement damage. Clamps or spring retainers are not successful. This so because access to tighten the clamps is restricted. Clamps also loosen and springs lose tension because of heating and cooling inherent in the machine operation.

Yet a further disadvantage of the '322 apparatus lies in the design of the curing table which is required to be lengthy in order to completely cure the envelope surround the panel. The curing table often is required to be transported from site to site or to be disassembled. The design of the curing table in the '322 patent does not allow for convenient disassembly and minimal transportation space to be occupied when the apparatus is transported.

Yet a further disadvantage lies in the use of the ram which compresses the fiber material into the panel member. The ram according to the '322 patent is connected through a connecting rod to a rotating crank. There is no counterweight to dynamically balance the crankshaft assembly. The resultant shaking causes failures in the frame components of the ram assembly. In addition, large and unwieldy base members are required in an attempt to stabilize the movement of the machine.

Yet a further disadvantage relates to the shear assembly which shears the fiber as the ram advances into the shear opening. A flywheel in the '322 apparatus provides inertial force. If a foreign object such as a rock or other debris is encountered by the shear, a clutch in the flywheel releases the driving action of the flywheel from the ram. This is intended to prevent damage to the shear, ram and associated components. Because of the rotating speed of the crank assembly, however, damage will have occurred before the clutch has disengaged. In addition, movement of the heavy ram and crank assembly has high kinetic energy, so damage can occur while it decelerates regardless of whether the clutch is engaged or disengaged.

Yet a further disadvantage of the '322 apparatus relates to the method used to adjust the space between the upper and lower platens which space must be adjusted in order to regulate the proper density of the fiber panel. A wedging and bolting apparatus was used to do this in the apparatus according to the '322 patent. This mechanism was difficult to properly adjust and was unnecessarily complicated.

Yet a further disadvantage of the '322 apparatus relates to the mounting of the rollers within the ram carrier and guide roll assembly. The rollers of the Dvorak apparatus are mounted in a V-type bearing configuration. When the position of the rollers needs to be changed, the adjustment is complex and unnecessarily time consuming since adjusting one roller will effect the position of the remaining rollers.

SUMMARY OF THE INVENTION

According to one aspect of the invention, there is provided apparatus to form a panel from fibrous material comprising a debailer/shredder, said debailer/shredder having a rotary cylinder, a plurality of adjustable knives in the bottom of said cylinder to remove fibers of a predetermined length from a bail placed in said cylinder while said cylinder is rotating and a collector chamber located beneath said rotary cylinder to collect said fiber removed from said bail.

BRIEF DESCRIPTION OF THE SEVERAL VIEWS OF THE DRAWINGS

Specific embodiments of the invention will now be described, by way of example only, with the use of the accompanying drawings in which:

FIG. 5 is an enlarged view of the crank throw arm of the crank shaft assembly of FIG. 4 particularly illustrating the attached counterweight;

FIG. 6 is a front diagrammatic partially sectional view of the ram assembly of FIG. 3 and particularly illustrating the rollers with horizontal axes on which the assembly moves;

DESCRIPTION OF SPECIFIC EMBODIMENT

Figure 1A:
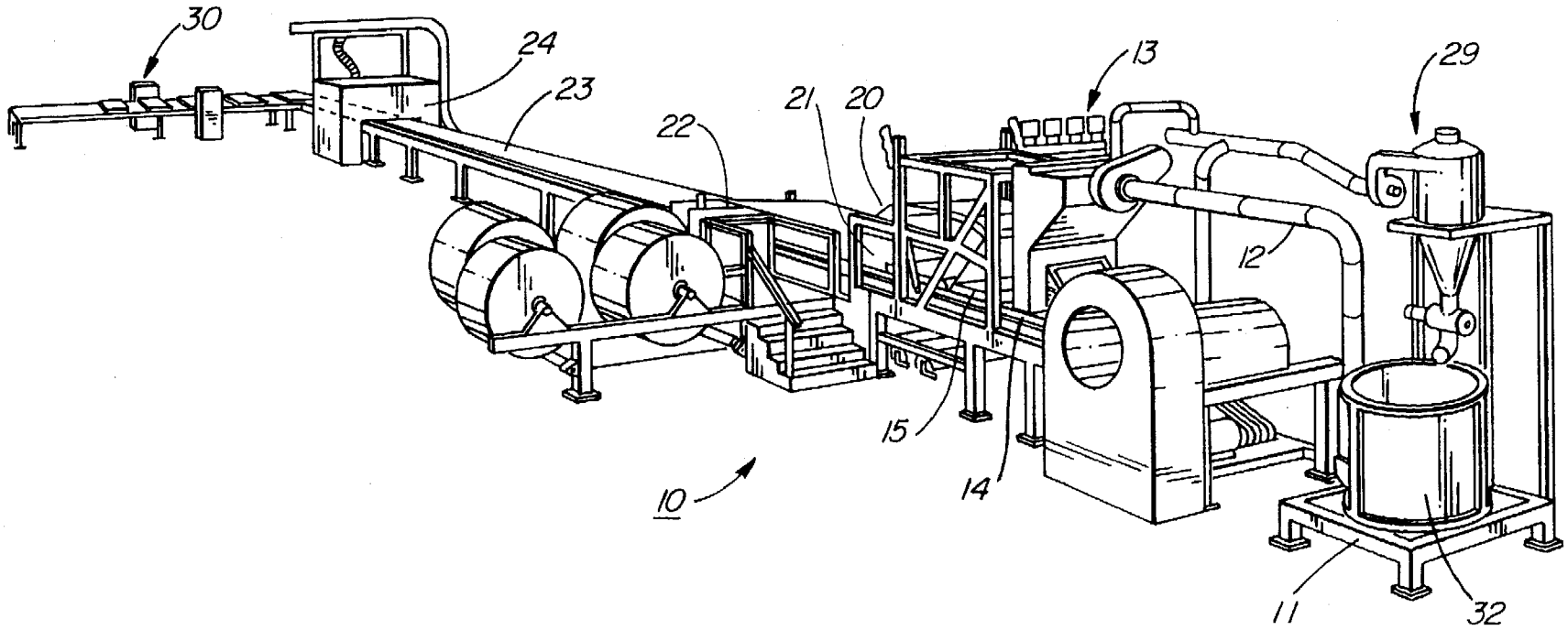
FIG. 1A is a perspective view of the fiber panel and manufacturing apparatus according to the invention.

Reference is now made to the drawings and, in particular, to FIG. 1A. The panel forming apparatus according to the invention is generally illustrated at 10. It comprises several sections, namely the debailer/shredder section generally illustrated at 11 into which the fiber is placed, a conveyor section generally illustrated at 12 which transports the separated fibers from the debailer/shredder section 11, the feeder section generally illustrated at 13 which receives the shredded transported fiber from the conveyor section 12, the ram slot fiber-panel assembly area 14 in which the fiber from the feeder section 13 is assembled and forced into the compaction area 15 and pressed into the panel shape, the glue application area generally illustrated at 20 which applies glue to the envelope paper and, thereafter, the paper to the fiber, the envelope forming area generally illustrated at 21 which forms the envelope surrounding the fiber material, the paper feeder section generally illustrated at 22 which feeds the paper from the paper rolls to the envelope forming area 21, the longitudinal curing table section generally illustrated at 23 on which the glue and paper surrounding the panel members are cured, the sizing saw section generally illustrated at 24 which receives the cured panel members and cuts them at the desired length and the finishing section generally illustrated at 30 which receives the completed cured and sized panels.

Figure 1B:
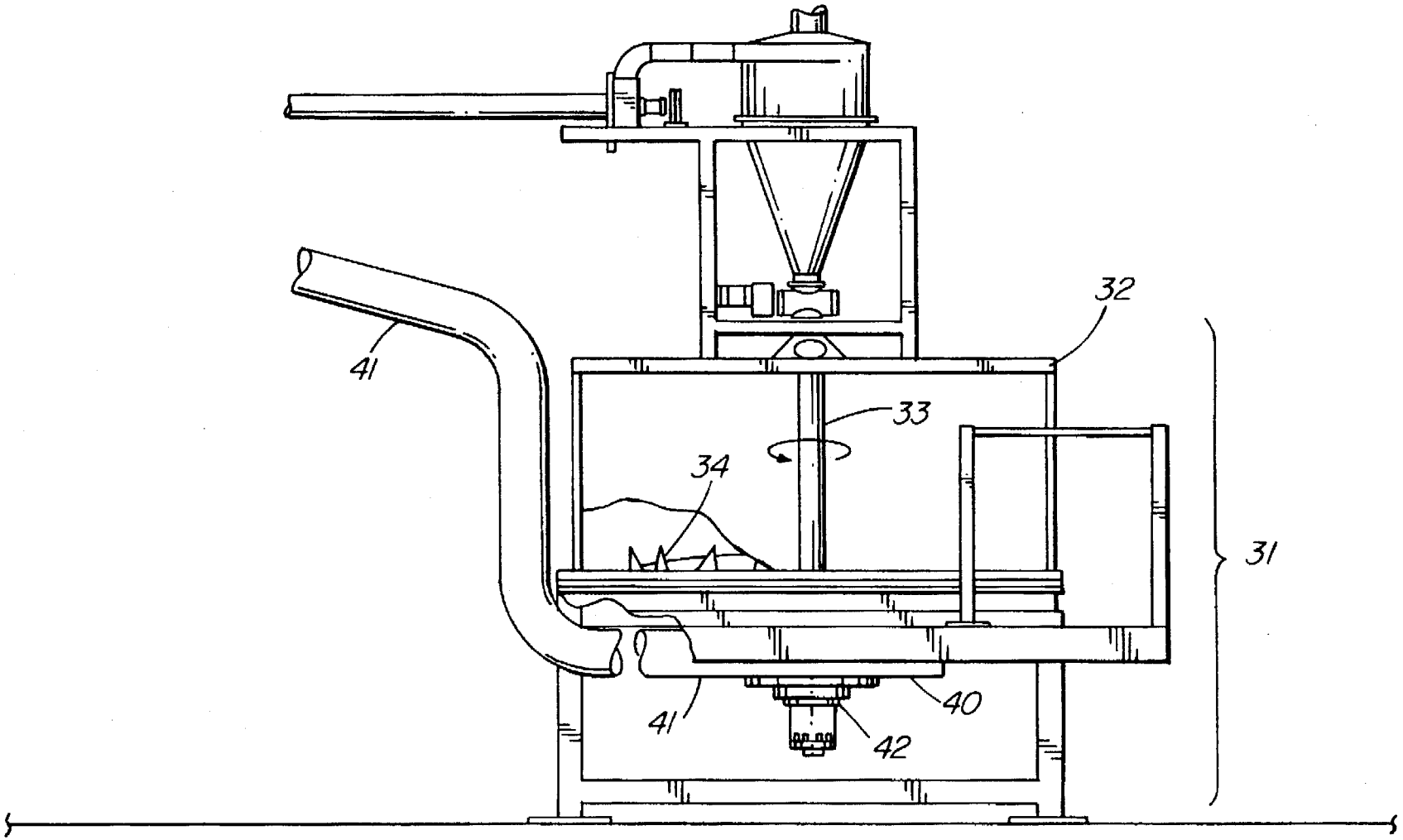
FIGS. 1B(*a*) through 1B(*e*) are each, respectively, diagrammatic and enlarged side views of the apparatus of FIG. 1A taken consecutively from the feeding end.
Figure 1B:
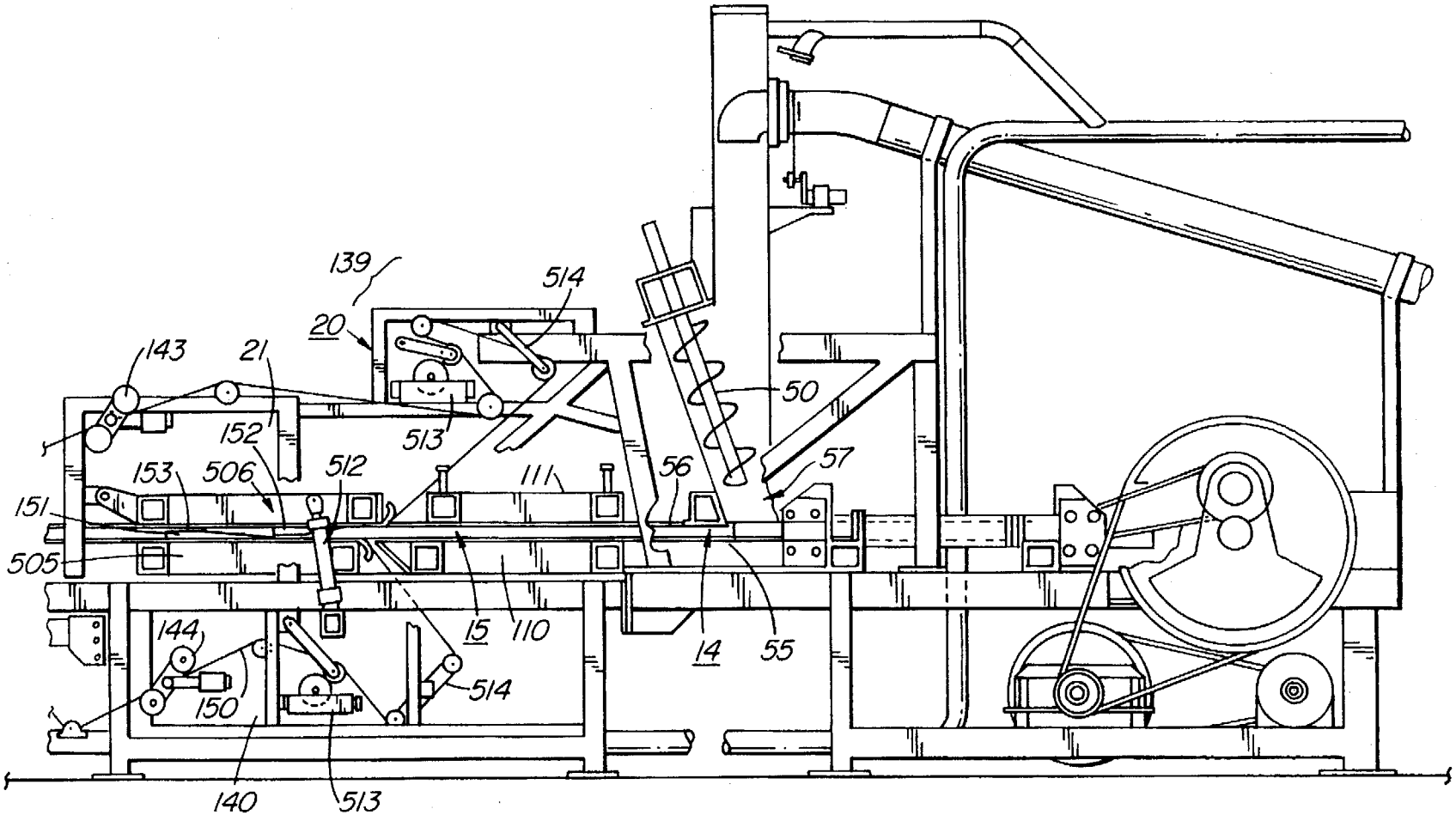
Figure 1B:
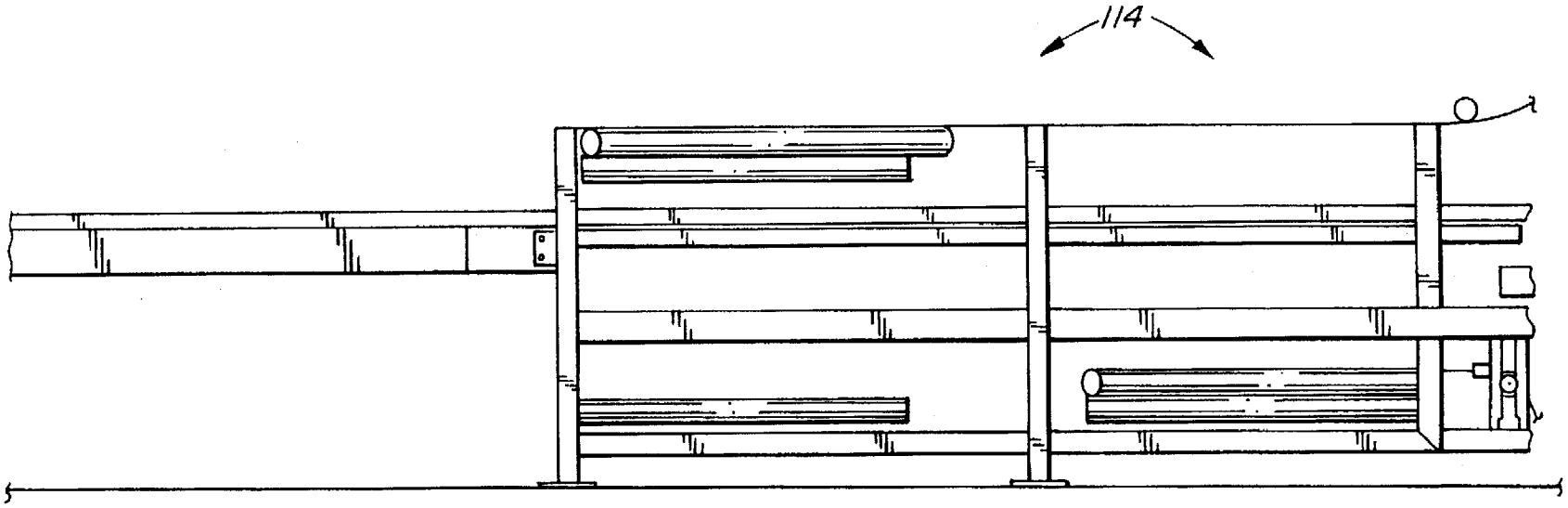
Figure 1B:
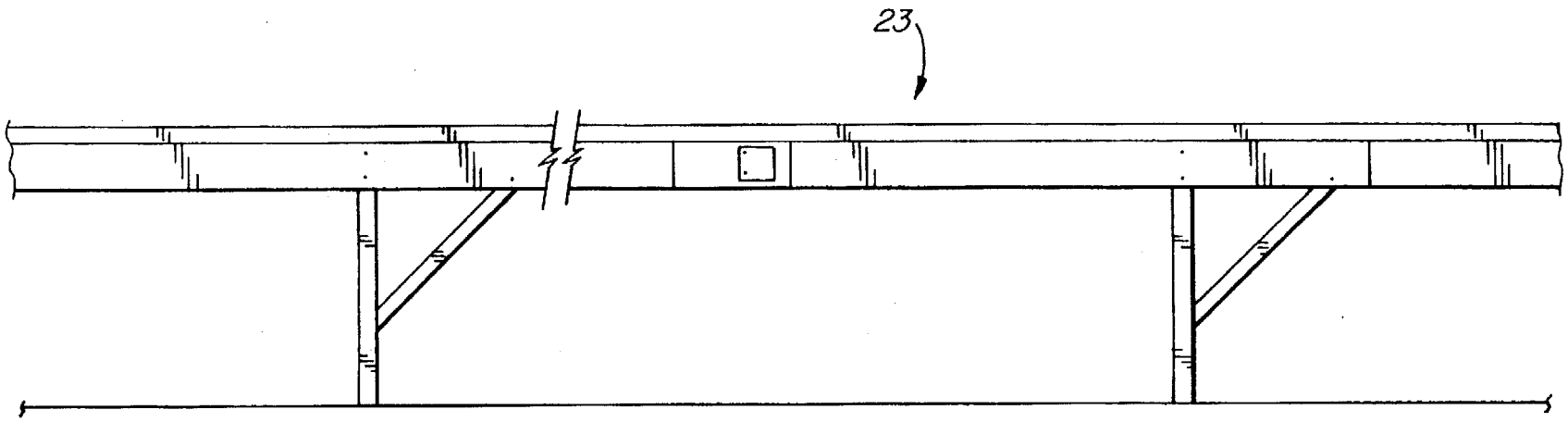
Figure 1B:
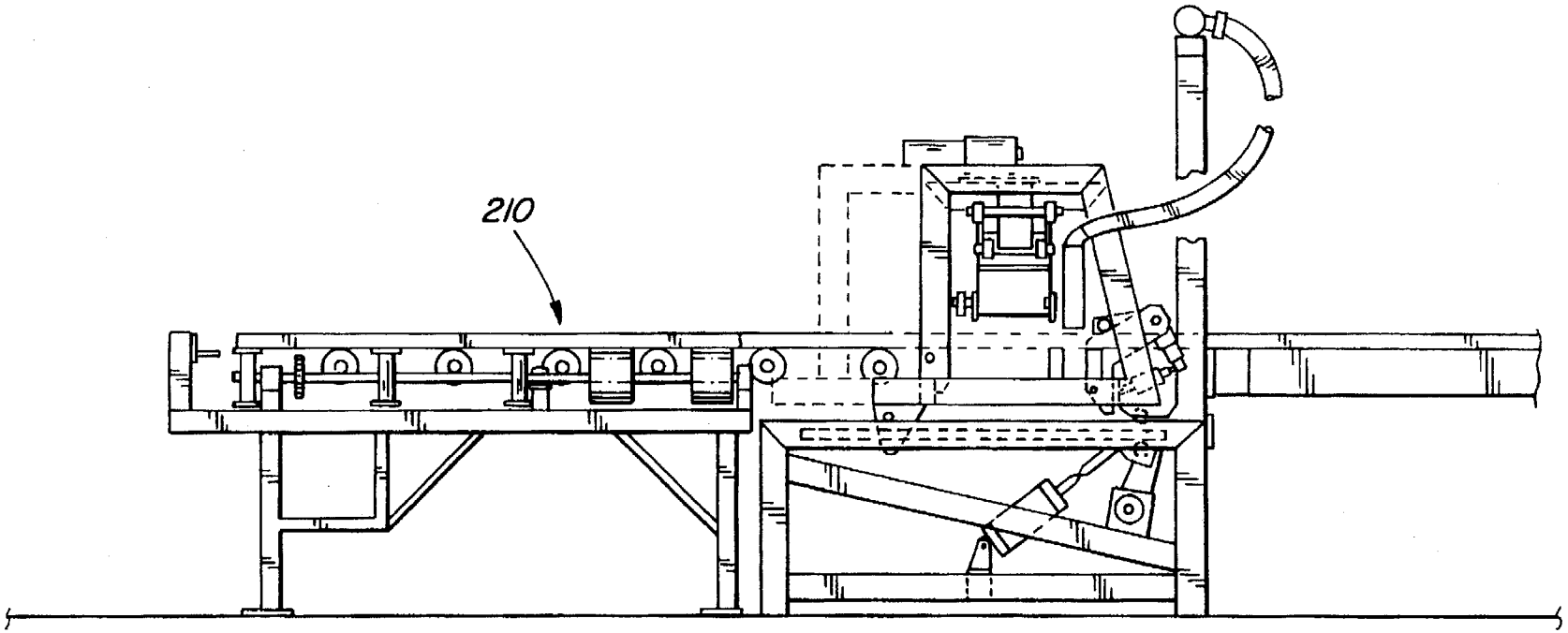

Referring now to the rightward area of the panel forming apparatus 10 and with reference to FIG. 1B(*a*), the debailer/shredder section 11 includes a debailer 31 which is commercially available for cutting the baled fiber which is in a circular or rectangular bale configuration as is known. The bale (not shown) is placed in a rotary cylinder 32 which rotates about vertical axis 33 and has a plurality of knives 34 which are height adjustable and which allow the fiber of the bale to be cut relatively long or relatively short as the cylinder 32 rotates.

A chamber 40 is formed below the rotary cylinder 32 and a conveyor 41 receives the severed fibers from the chamber 40 and transports the fibers to feeder section 13 (FIG. 1B(*a*)). The conveyor 41 is connected to a source of air pressure, conveniently a centrifugal blower 42, which blows the fiber received from the chamber 40 into the feeder section 13.

Figure 2A:
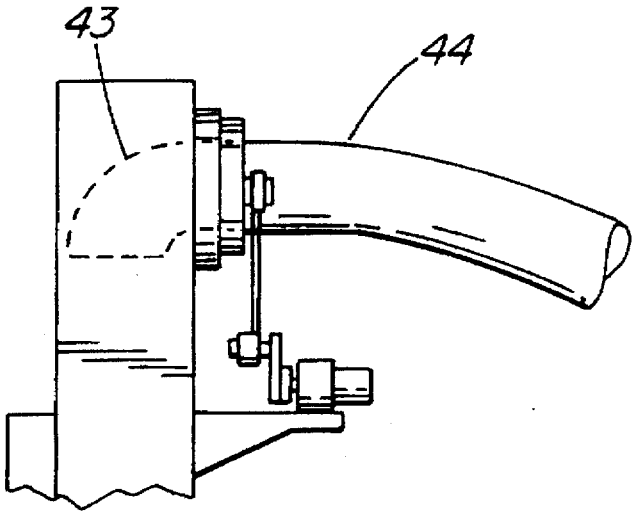
FIGS. 2A and 2B are diagrammatic side and front views, respectively, of the pneumatic fiber conveyor and the wig wag used to distribute the fiber.
Figure 2B:
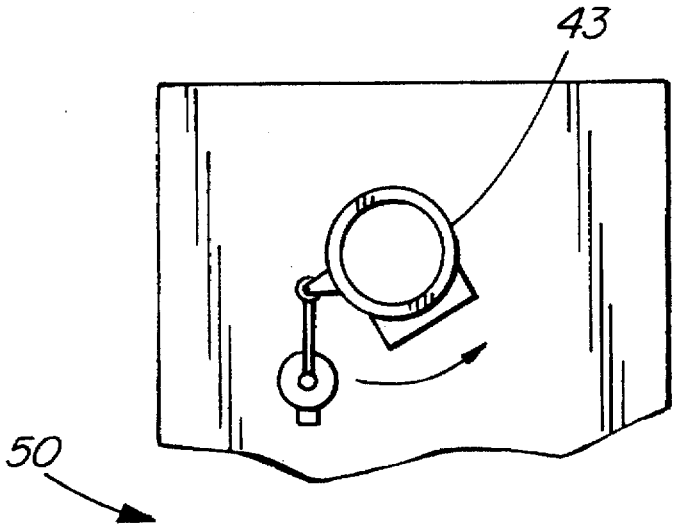

The feeder section 13 includes a wig wag distributor 43 (FIG. 2A) which receives the blown fibers from duct 44 (FIG. 2A) and reciprocates through about 90 degrees (FIG. 2B) as illustrated thereby evenly depositing the fiber in a battery of four (4) helical screw conveyors or augers 50.

Figure 3A:
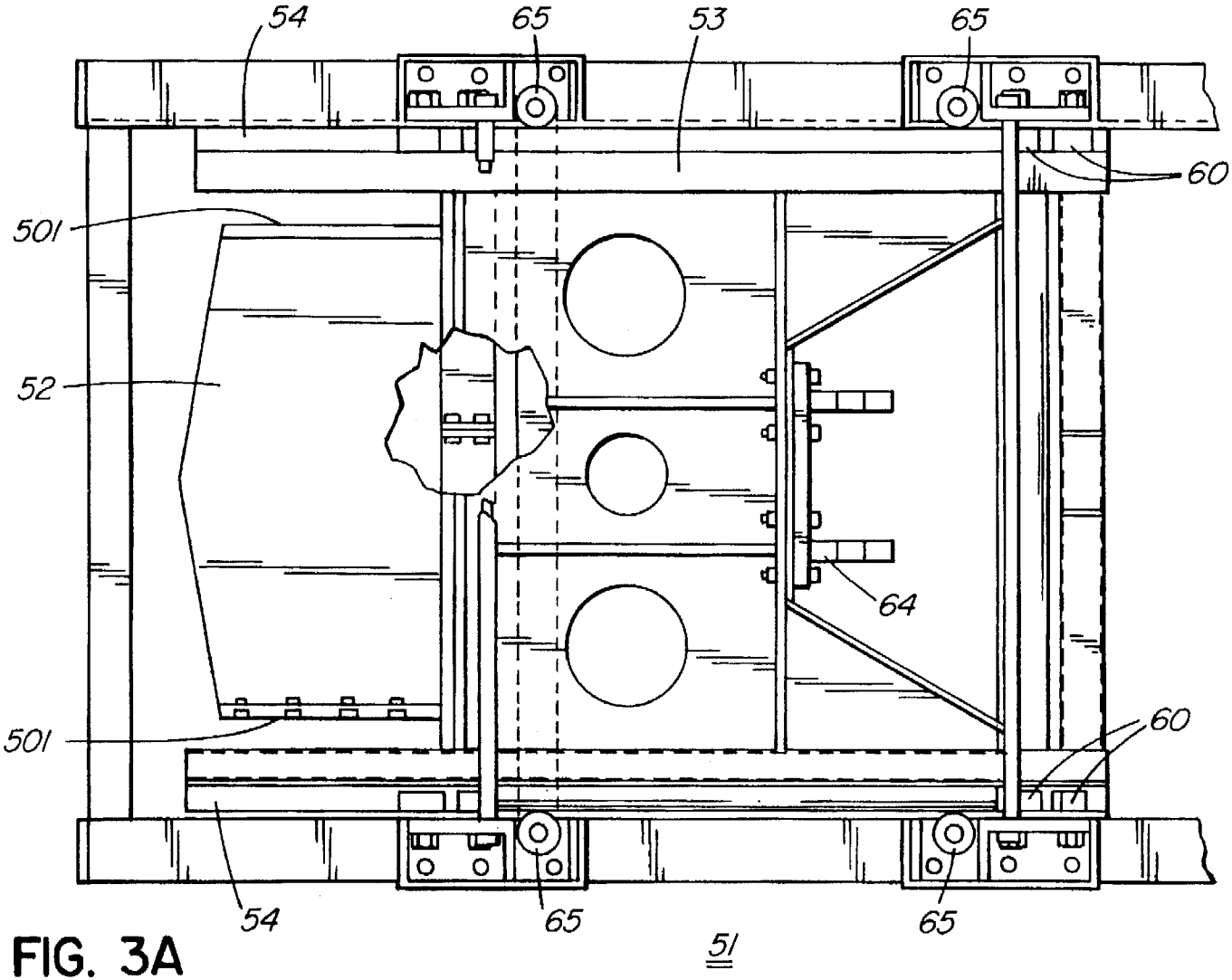
FIGS. 3A and 3B are diagrammatic plan and side views of the ram assembly according to the invention.
Figure 3B:
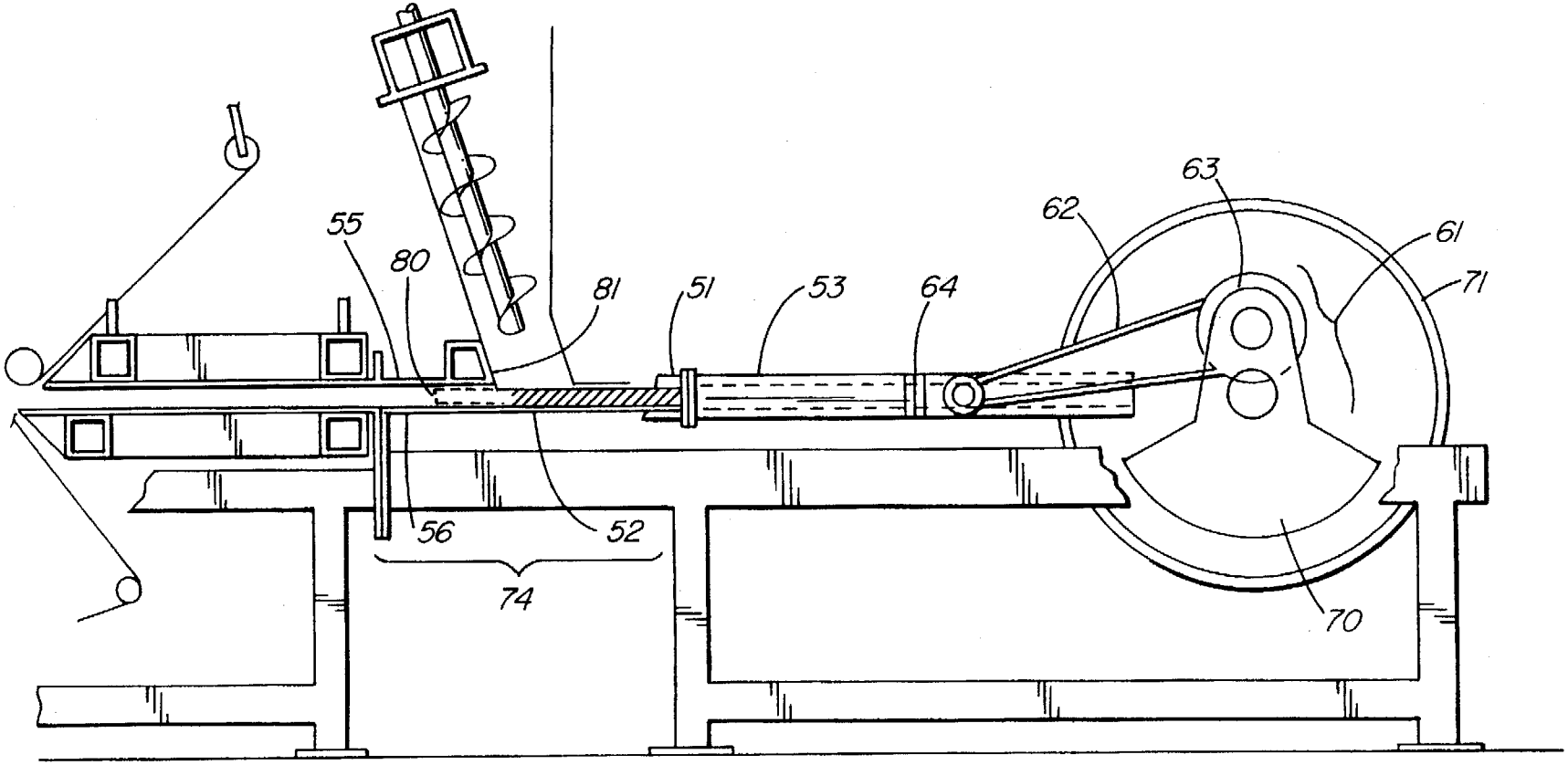
Figure 4:
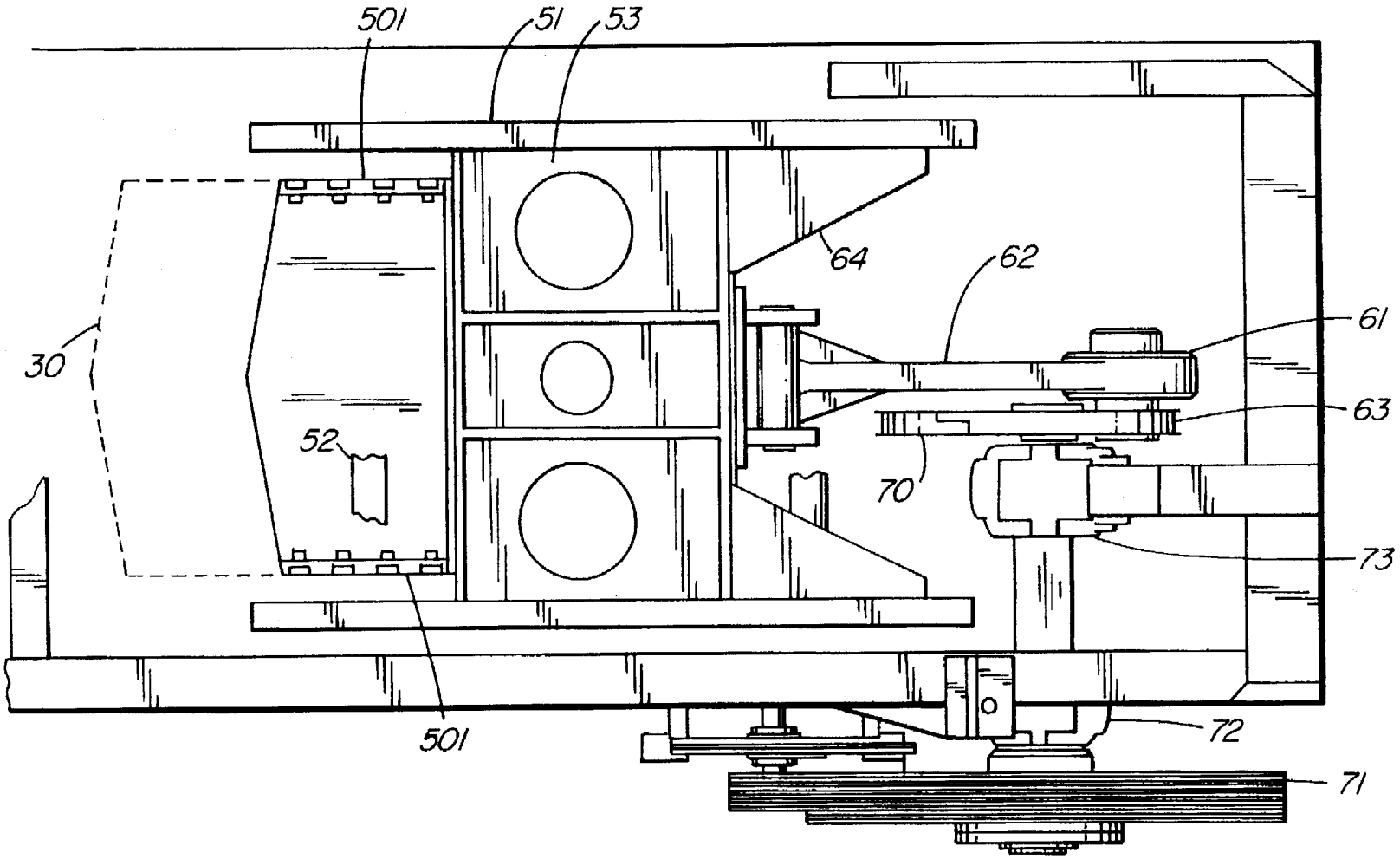
FIG. 4 is a plan of the crank shaft assembly which is used to drive the ram assembly of FIGS. 3A and 3B.
Figure 7:
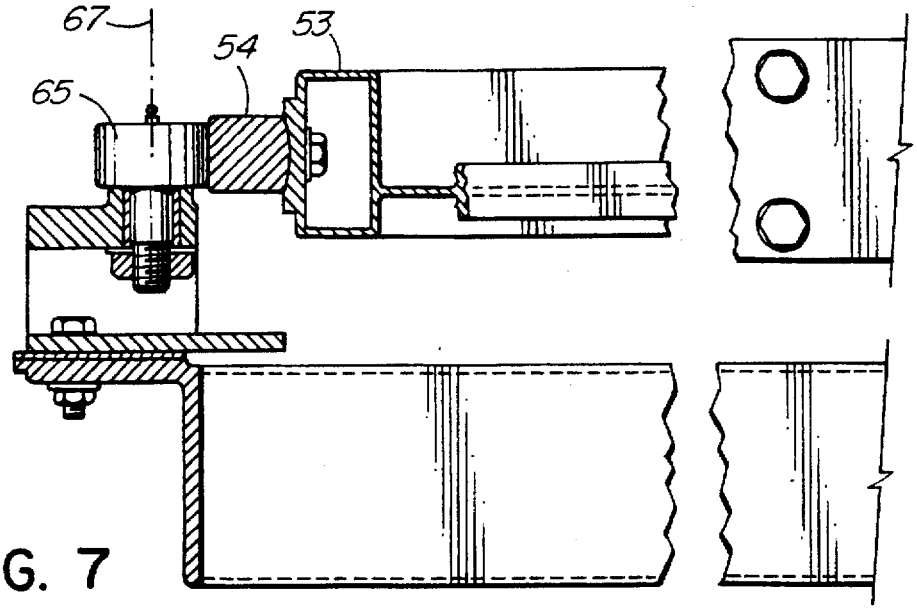
FIG. 7 is a further view of the ram assembly similar to FIG. 6 but illustrating the rollers with vertical axes on which the assembly moves.

With reference now to FIG. 3, the ram assembly is seen in plan and is generally illustrated at 51. It includes a ram head 52 removably attached to the ram body 53. The ram head 52 has detachable side plates 501 that may be removed or interchanged with different side plates to change the width of the panel being manufactured. The ram body 53 and ram head 52 reciprocate on roller rails 54 with the use of rollers 60,65. Rollers 60 rotate about axes 66 (FIG. 6) which axes are generally parallel to the plane of movement of the ram body 53 on the roller rails 54. Rollers 65 rotate about axes 67 (FIG. 7) which are generally transverse to the plane of movement of the ram body 53 on the roller rails 54. Ram body 53 is connected to the crank shaft assembly generally illustrated at 61 (FIGS. 3B and 4). A connecting rod 62 is connected to the crank arm 63 and to the wrist base 64 of the ram body 53 (FIG. 3B). Crank throw 63 has a counterweight 70 attached thereto as also seen in FIG. 5. The flywheel 71 rotates on the outside of a pillow block 72 (FIG. 4). The crank arm 63, counterweight 70 and connecting rod 62 rotate with the flywheel pulley 71 and outside pillow block 73.

Figure 8:
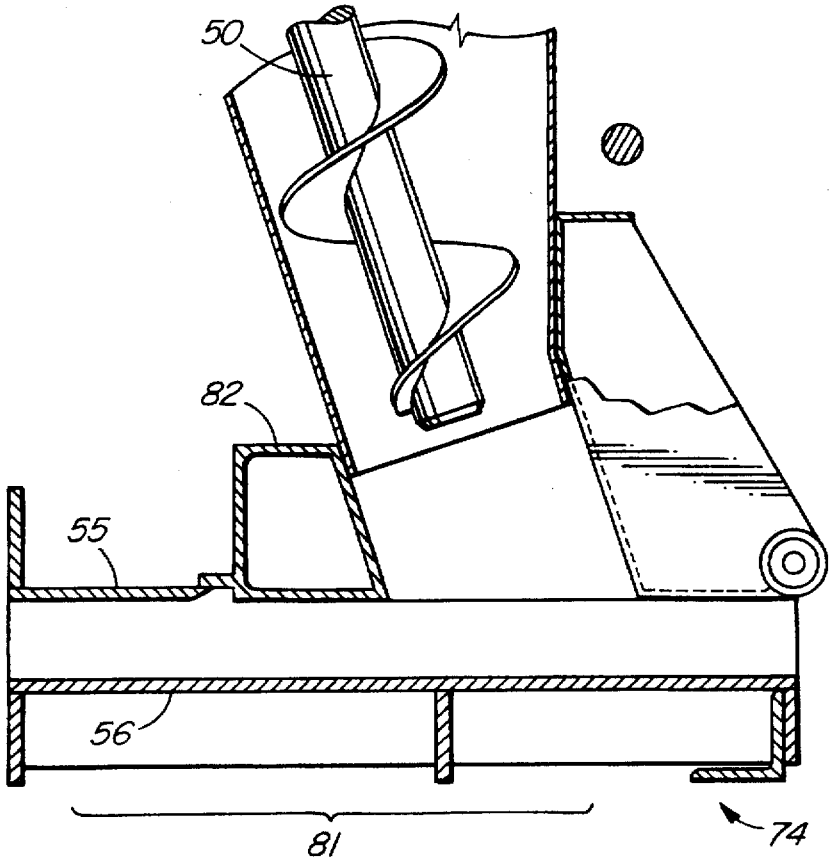
FIG. 8 is a side diagrammatic view of the ram slot assembly in which the ram head moves and partially illustrating the shear.
Figure 9A:
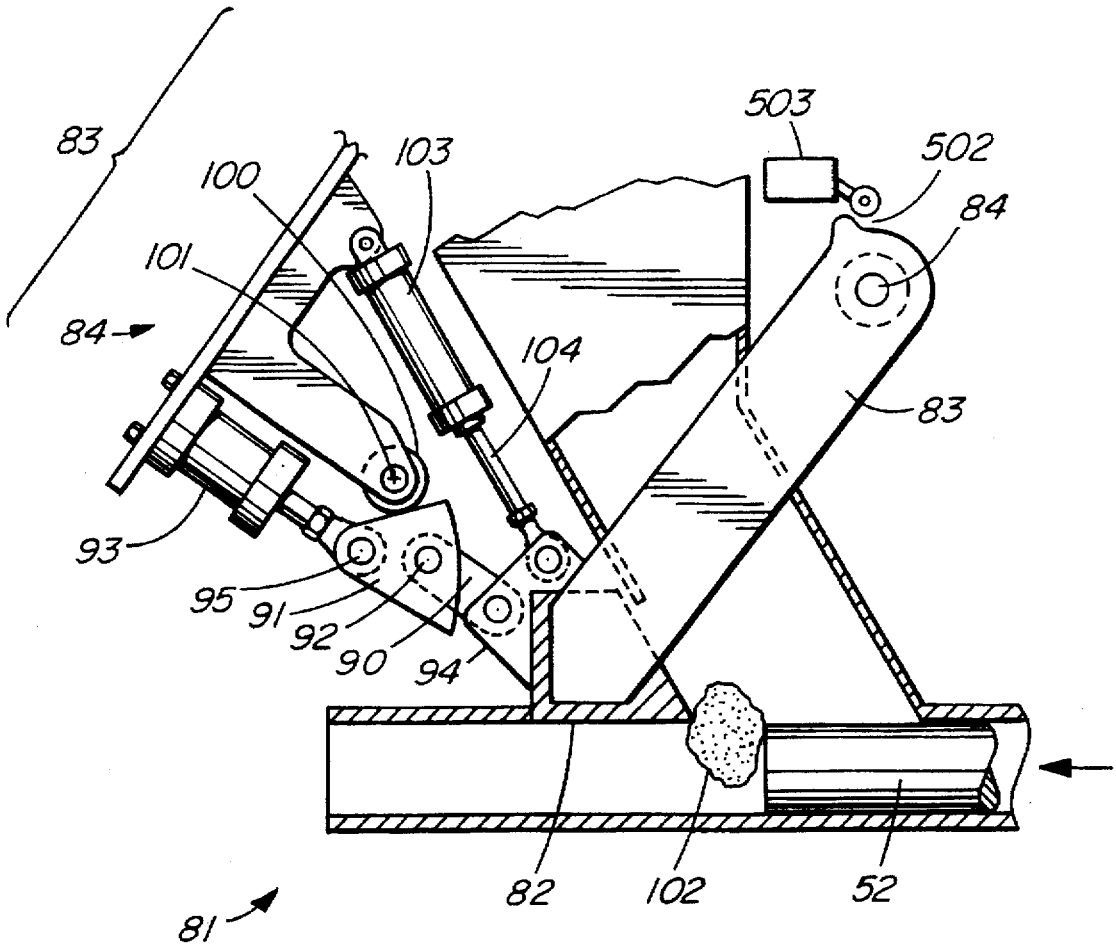
FIGS. 9A, 9B and 9C are diagrammatic views taken from various elevations illustrating the shear assembly according to the invention.
Figure 9B:
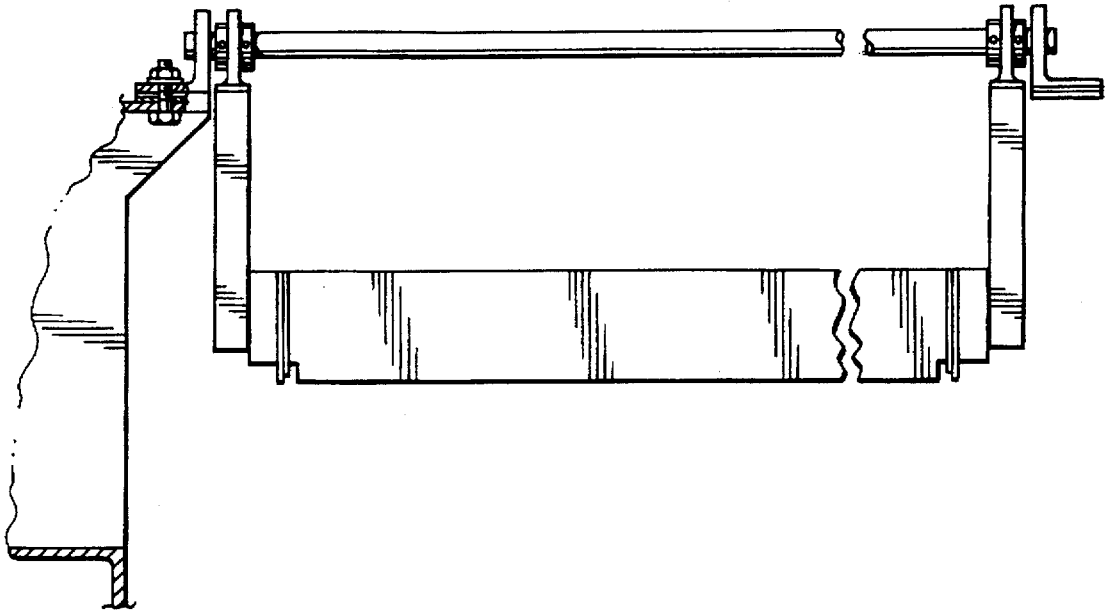
Figure 9C:
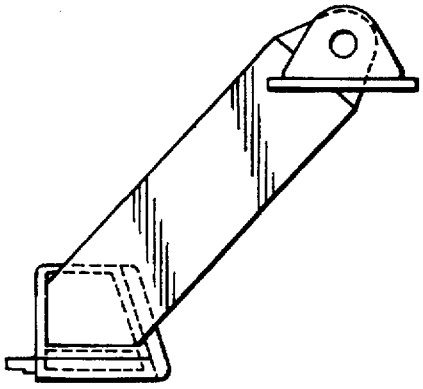

The ram slot assembly is generally illustrated at 74 in FIGS. 3B and 8. The ram slot assembly 74 comprises three components, namely a lower plate 56, an upper plate 55 and a shear 81. The ram head 52 reciprocates within the ram slot assembly 74 with the furthest advanced position of the ram head 52 being shown at 80 (FIG. 3B). The shear assembly is generally illustrated at 81 and is shown in more detail in FIGS. 9A, 9B and 9C. A shear release mechanism 83 comprises two links 90, 91 which allow relative motion therebetween about axis 92. Link 91 is connected at the end remote from axis 92 to a pneumatic cylinder 93 at axis 95. Link 90 is connected to the shear 82 at axis 94 and axis 92 is slightly offset if a line is drawn between axes 94, 95. A cam 100 is mounted and rotatable about axis 101. If a rock or other hard debris 102 is encountered by the shear 82 as the ram advances, the shear will be forced backwards pushing the links 91, 92 against the holding force of cylinder 93. As link 91 moves backwards, cam 100 rotating around pin 101, forces the link 91 to rotate clockwise about axis 95. This unlocks the over-center rigidity between links 91, 92 thereby allowing axes 94, 95 to come more closely together. Shear 82, pivoted about axis 84, is allowed to swing away from obstruction 102 and is held clear by the upward motion of piston rod 104 of pneumatic cylinder 103. Cam 502 mounted on shear 82 arm trips limit switch 503 which terminates operation of the entire panel system to prevent damage. When the rock 102 has been removed, pneumatic cylinder 103 will act downwardly extending piston 104 and returning the shear 82 to its operating position.

Figure 10A:
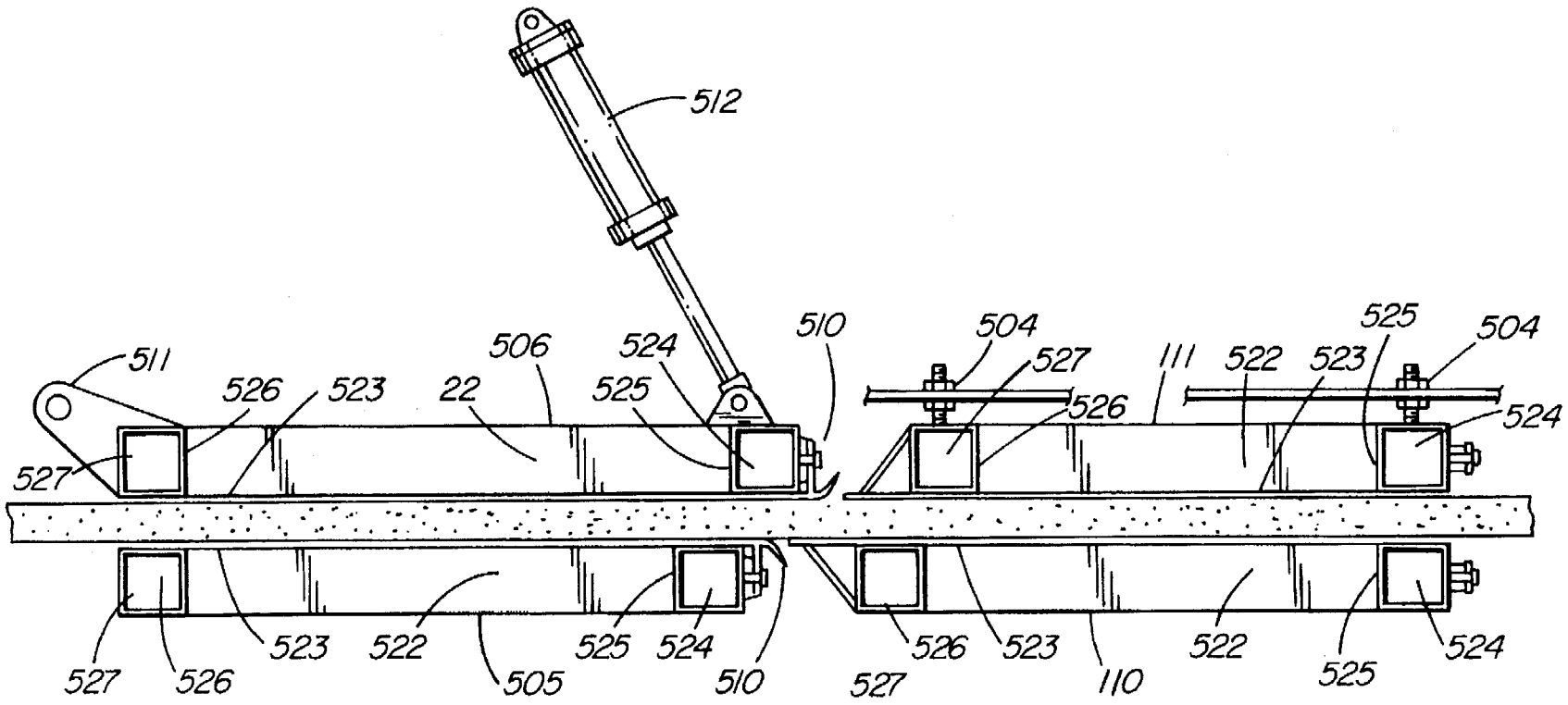
FIGS. 10A and 10B are views of the primary and secondary platens in which the fiber moves and the platen adjustment according to the invention.
Figure 10B:
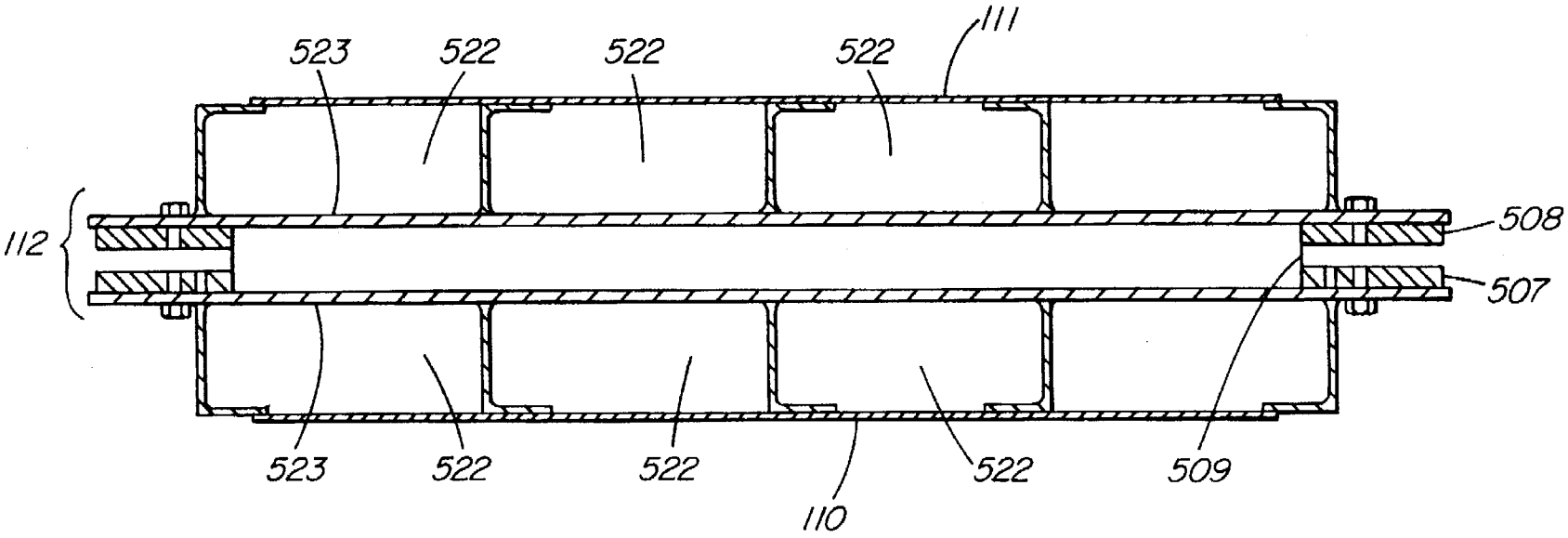

The platen assembly is generally illustrated at 15 in FIGS. 10A and 10B. It comprises a primary set with an upper adjustable platen 111 and a lower fixed platen 110 (FIG. 10A). There is also a secondary set with an upper adjustable and hinged platen 506 and a lower fixed platen 505 (FIG. 10A). The primary set forms the extruder unit whereby the fiber from the ram slot assembly 74 (FIG. 3B) is compacted to form a dense panel. The width dimension of the fiber panel is determined by assemblies 112 (FIG. 10B).

The side assemblies 112 consist of three components, a lower bar 507 affixed to lower platen 110, an upper bar 508 affixed to upper platen 111 and a closure "T" shaped blade 509 attached to bar 508 and resting against the inner faces of bars 507, 508. Regardless of any adjustment made to upper platen 111, the side assemblies 112 keep the sides enclosed such that the fiber panel width is uniform and smooth. If a narrower panel is desired, these side assemblies 112 are replaced with a different set of bars 509, 508, as may be desired.

The density or compaction of the fiber panel is determined by the position and taper imposed upon the upper platen 111. This is done by adjusting jam nuts on the adjusting screws 504 (FIG. 10A).

The secondary platens 505, 506 (FIG. 10A) receive glue lined paper from the gluer assembly 10 (FIG. 1B) and form it into an envelope around the advancing compacted fiber. The paper enters the platens around curved shoes 510 (FIG. 10A). The paper is propelled by the advancing fiber. Upper platen 506 is pivoted about axis 511. It is rotated upward by pneumatic cylinder 511. This provides access for cleaning and inspecting the secondary platens.

Figure 11A:
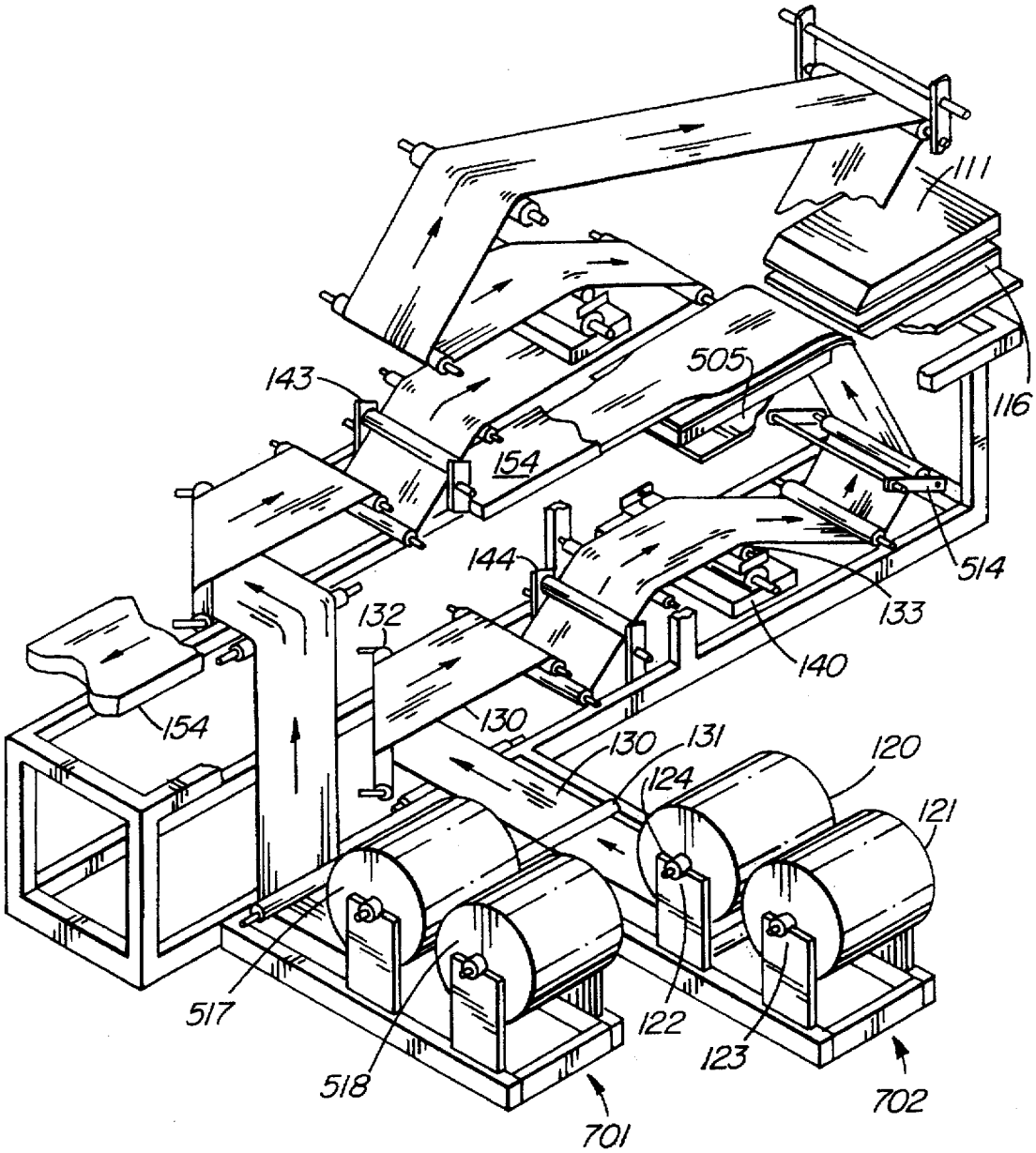
FIG. 11A is a diagrammatic isometric view of the paper rolls mounting, the web trail through to and into the platen area and the adhesive or glue applicator according to the invention.

The paper feed apparatus is illustrated generally at 114 in FIG. 1B and 11A. Two separate paper systems are used to provide paper for the paper envelope of the panel member. The first paper line 701 provides the wrap for the upper face of the fiber panel and the second paper line 702 provides wrap for the lower face of the panel. Only the lower or second paper line 702 will be described as the operation of both lines is similar.

First and second paper rolls 120, 121 are positioned on spindles 122, 123, respectively, which are rotatable on brackets, 124, 124, respectively. The axes of rotation of the spindles 122, 123 and, thus, the paper rolls 120, 121 are longitudinal or parallel to the longitudinal axis of the paper forming apparatus 10 (FIGS. 1A and 1B). The paper rolls 120, 121 are mounted so as to allow for rolls of standard sizes to be used thereby reducing the expense involved in obtaining paper rolls of custom configuration. The paper 130 extends from the first paper roll 120, under first guide roller 131, to a turning bar 132 which uses air to lubricate the paper 130 which passes under and then over the turning bar 132 where the direction of movement of the paper 130 turns through an angle of ninety (90) degrees and passes over the applicator or doctor roller 133 of the glue applicator apparatus 140. Glue from the glue tray 513 is picked up by transfer roller 134, transferred to doctor roller 133 and, thence, onto paper 130.

The paper 130 with the glue applied to the under surface 141 passes over a second guide roller 142 and around wave rectifier roller 514 and thence upwardly to the lower platen 505 where it contacts the fiber (not shown) compressed by the ram head 52 (FIG. 3B) moving between the platens 110, 111, 505, 506. The paper 130 forms the envelope for the fiber as will be explained.

The wave rectifier 514 consists of a roller 533 mounted on a crank arm assembly 534 that rotates about axis 535. A pneumatic cylinder 536 connects to the crank arm at pin 537.

The cylinder holds outward force on the roller 533. The crank arm moves back and forth with the jerking motion of the paper. If the flow of incoming paper 130 to the roller 533 becomes restrained, the force of the cylinder 536 will be overcome allowing the crank arm to move to an over-travel position 538 where it trips limit switch 539 thereby terminating operation of the system.

When paper roll 120 is nearly unrolled and the end of the paper approaches, the leading edge of the paper roll 121 is taped to it. This automatically feeds the paper 130 from the new roll 121 into the system.

Tensioners 143, 144 (FIG. 1B and FIG. 11A) may also be used in the paper feed apparatus 114. The tensioners 143, 144 keep the paper web 150 at the correct tension. The tensioners are adjustable counterweighted floating devices that impart a frictional drag to the movement of the paper, if required, such that slack does not develop in the paper. The wave rectifier roller 514 is an air cylinder cushioned device that oscillates to smooth out the jerking motion on the paper 130 caused by the cycling of the ram 51. This assists in reducing paper tear and paper breaking.

Figure 11B:
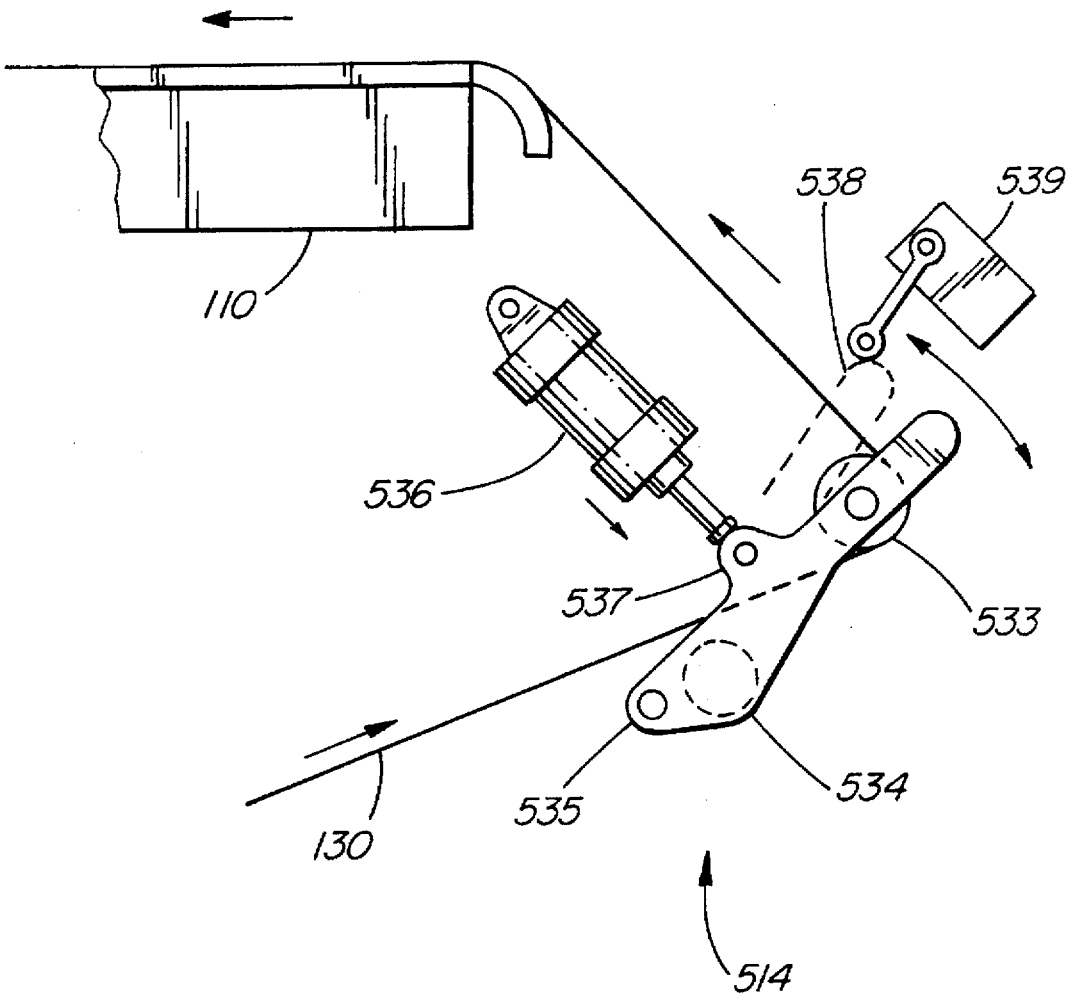
FIG. 11B is a diagrammatic side view of the wave rectifier roll apparatus according to the invention.
Figure 12A:
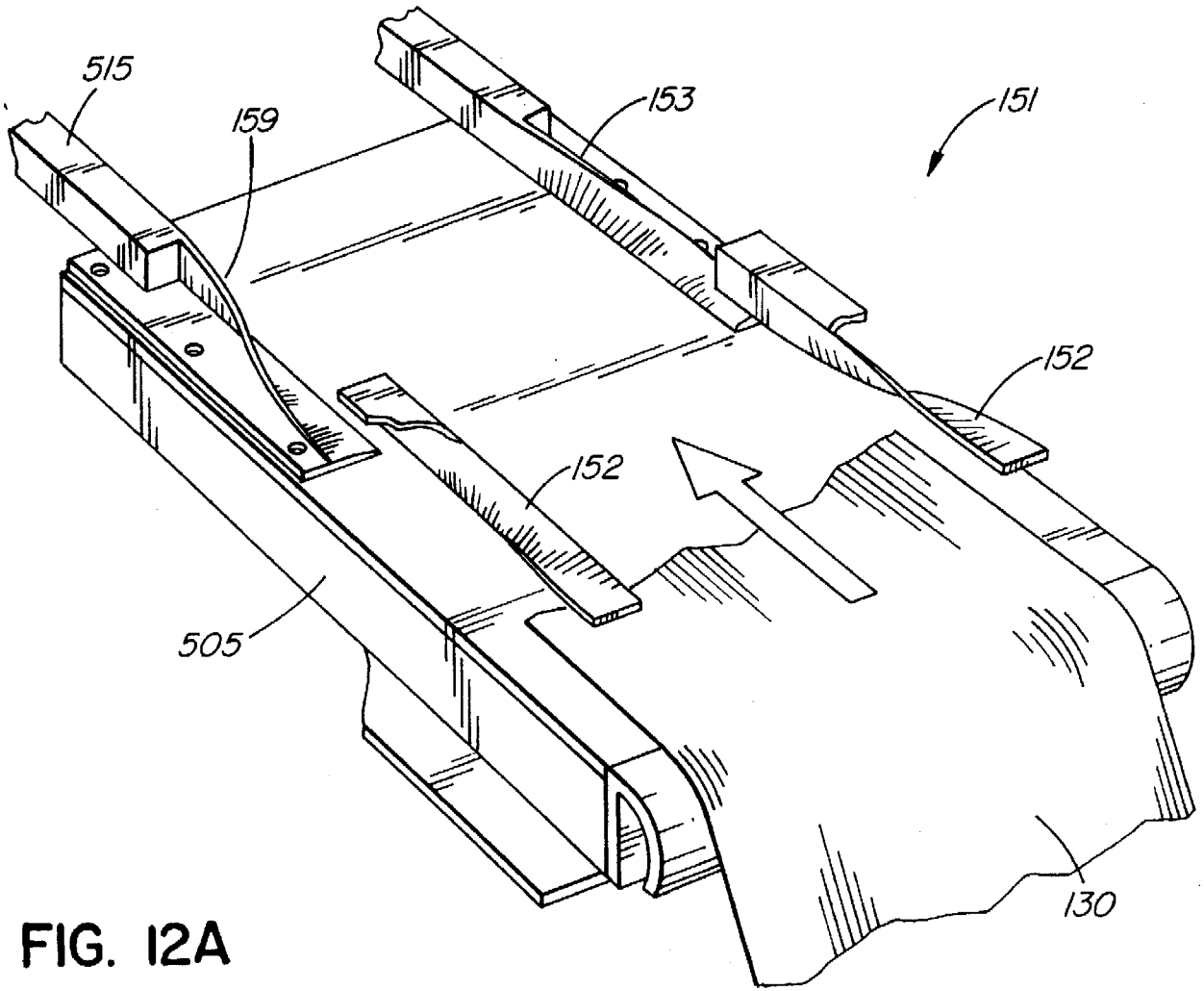
FIGS. 12A and 12B are views of the paper applicator envelope forming guides and the movement of the paper as influenced by the guides according to the invention.
Figure 12B:
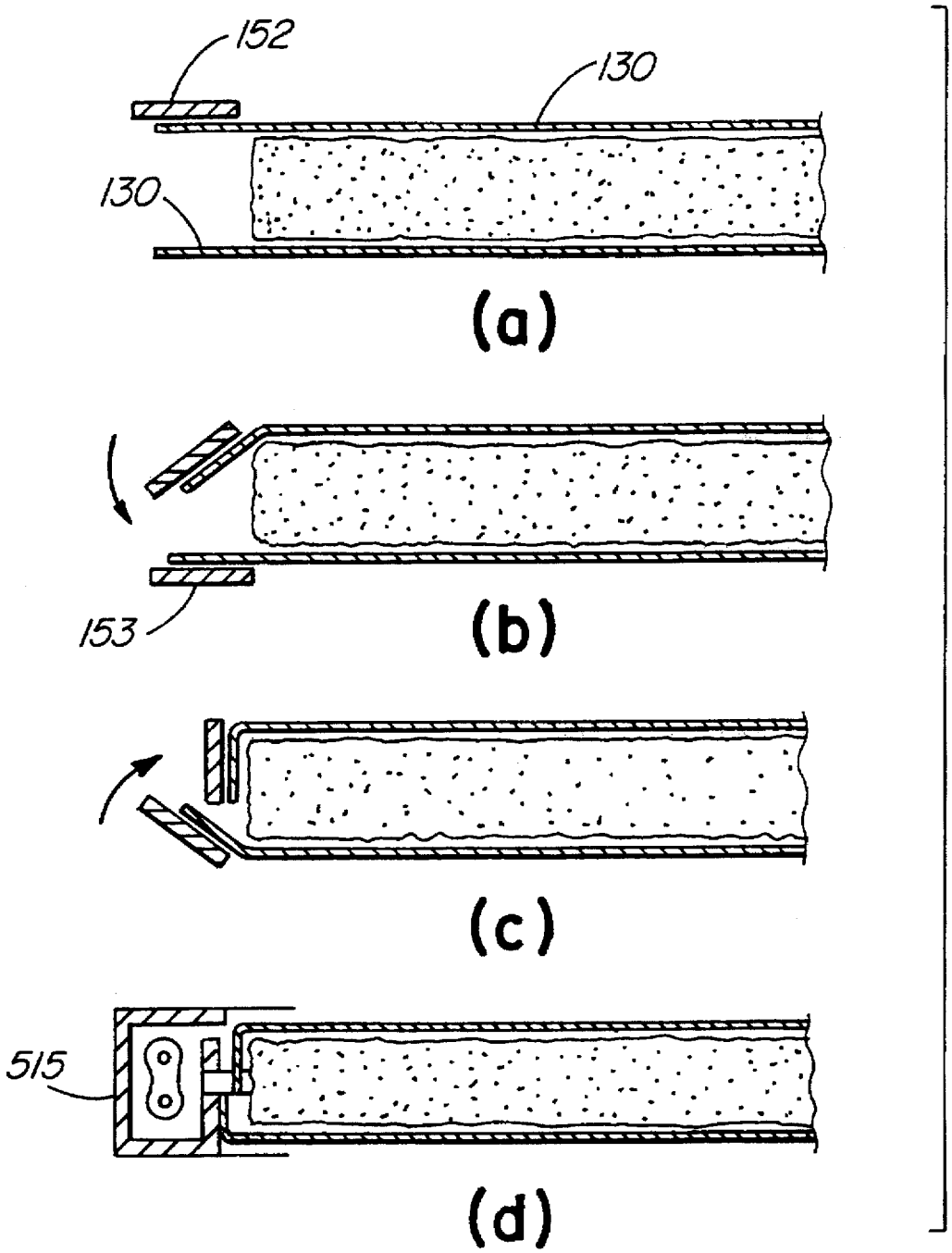

The envelope former assembly 151 is illustrated generally in FIG. 1B and, in greater scale and diagrammatically, in FIGS. 12A and 12B. Two helical bar pieces 152, 153 are positioned on each side at the top and bottom and outside the edges. It also shuts the system down before a break occurs (FIG. 11B). The paper 130 which extends outside the width of the fiber panel 154 as illustrated in FIG. 12B initially contacts the helical bar 152. As the panel 154 moves in the direction of the arrow (FIG. 12A), the paper 130 extending beyond the width of the fiber panel 154 is folded downwardly (FIG. 12B). Likewise, the paper 130 on the bottom of the panel 154 contacts the helical bar 153 which similarly folds the paper upwardly (FIG. 12B). An envelope is formed on each side of the endless fiber panel fiber panel 154.

Heating electrodes 515 on the sides of the lower folding bars 153 accelerate bonding of the edges of the paper together and to the edges of fiber panel 154 before it leaves the enclosure of the envelope forming area 21 (FIG. 1B).

Figure 18:
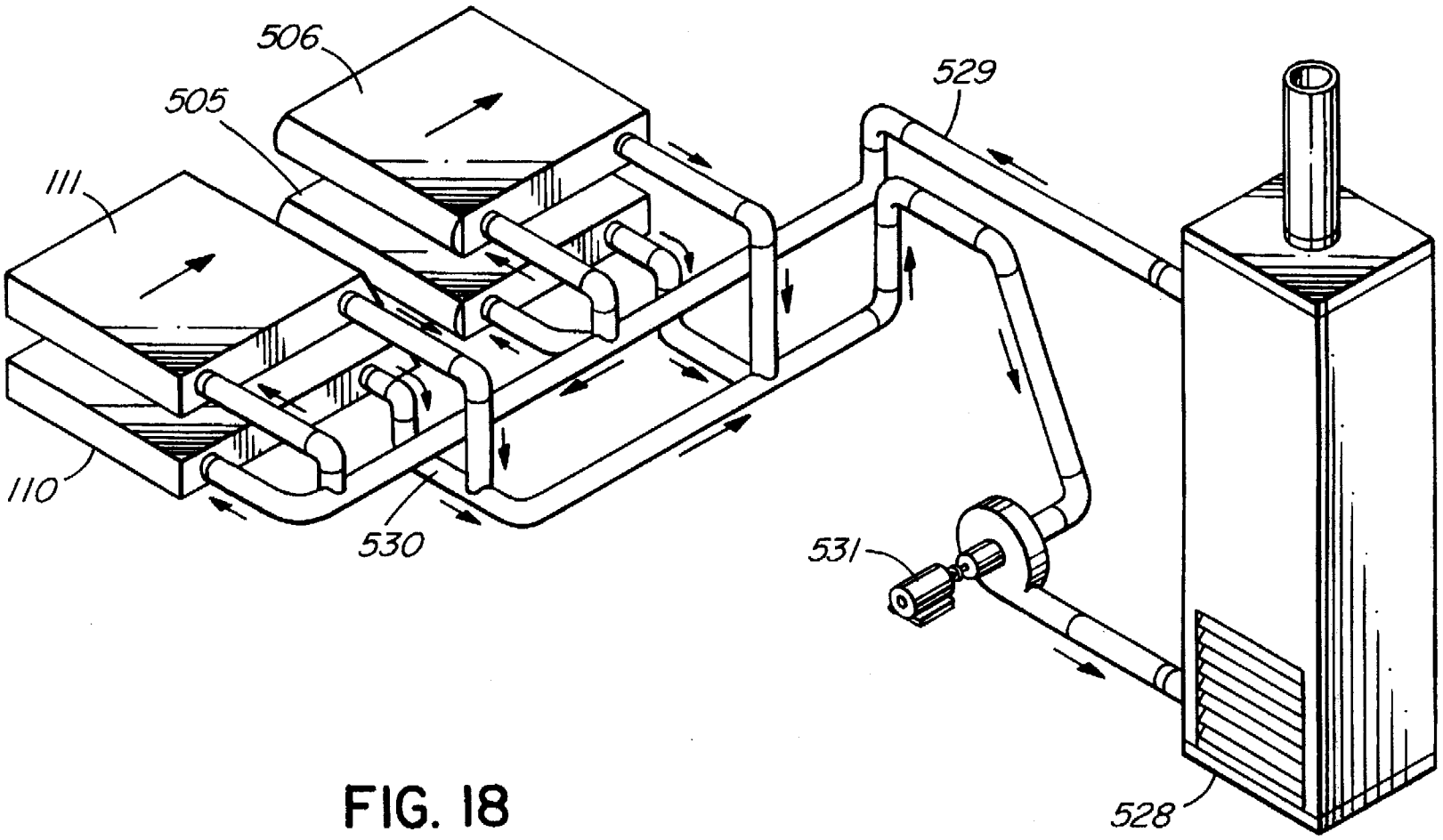
FIG. 18 is an isometric view of the platen hot gas heating system according to the invention.

The platens 110, 111, 505, 506 are assembled with a hollow plenum chamber 522 outside their contact plates 523. Inlet manifold 524 and vent openings 525 allow hot gases to enter to heat the plates 523. The gases pass across the plenum chamber and escape through vent openings 526 and out exhaust manifold 527 (FIGS. 10A, 10B). The heat provides preliminary curing and bonding of the fiber envelope before it passes onto section 23 of the curing table (FIG. 1B). The hot gases are conveniently provided by one of several sources depending on what is available at the installation location. Steam, electricity, gas or oil burners are convenient sources, for example. An industrial model gas fired unit 528 is illustrated in FIG. 18. A duct manifold 529 carries the hot gases to the platens 110, 111, 505, 506.

Return ducts 530 recycle the exhaust gases to the heating unit 528. A circulating fan 531 on the exhaust ducting moves the gases through the system.

Figure 13B:
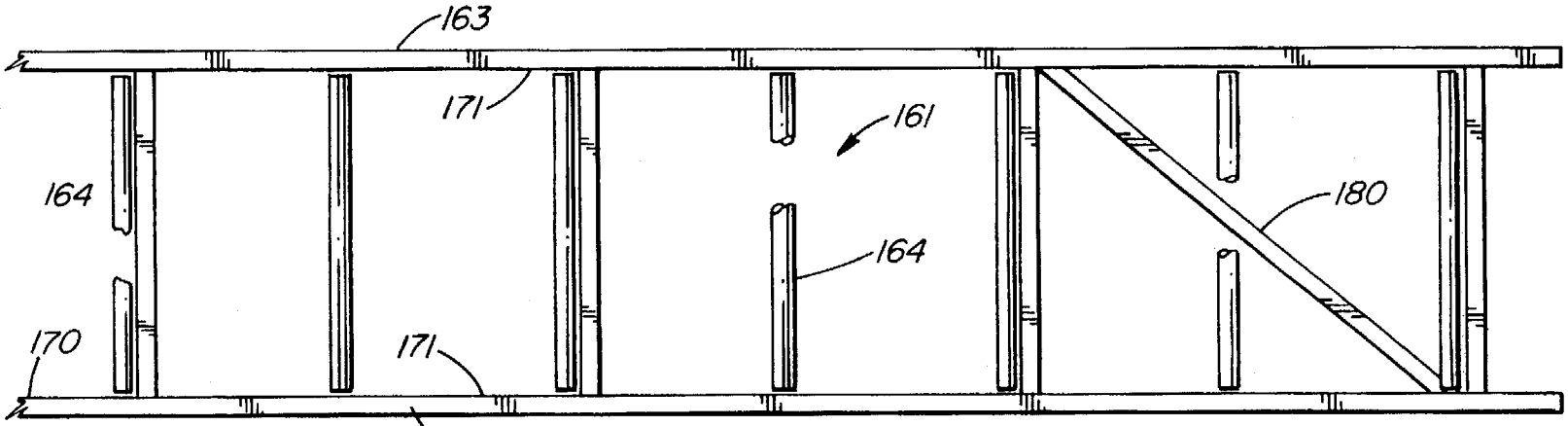
FIGS. 13A, 13B and 13C are side, plan and end views, respectively, of the curing table according to the invention.
Figure 13A:
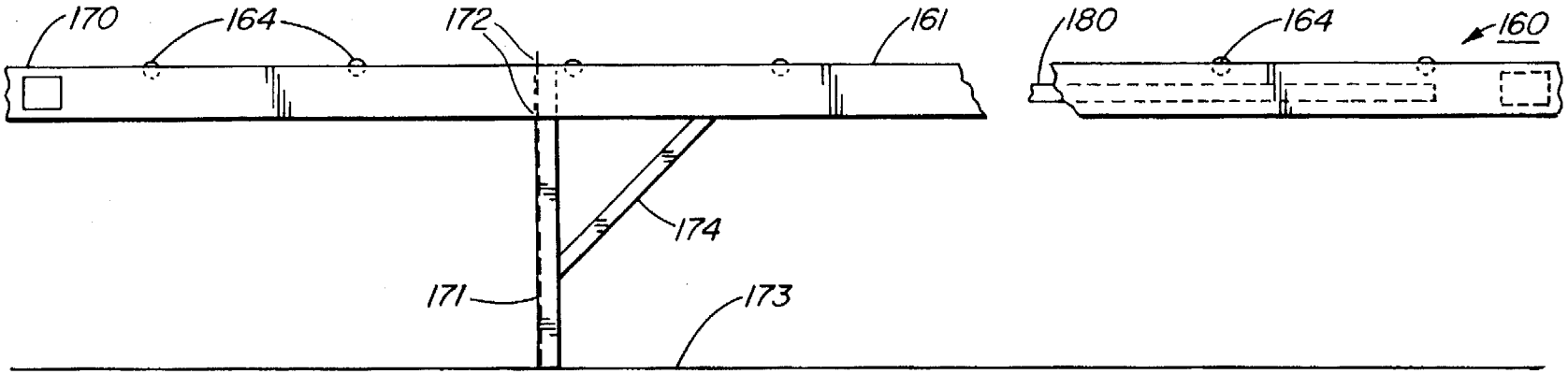
Figure 13C:
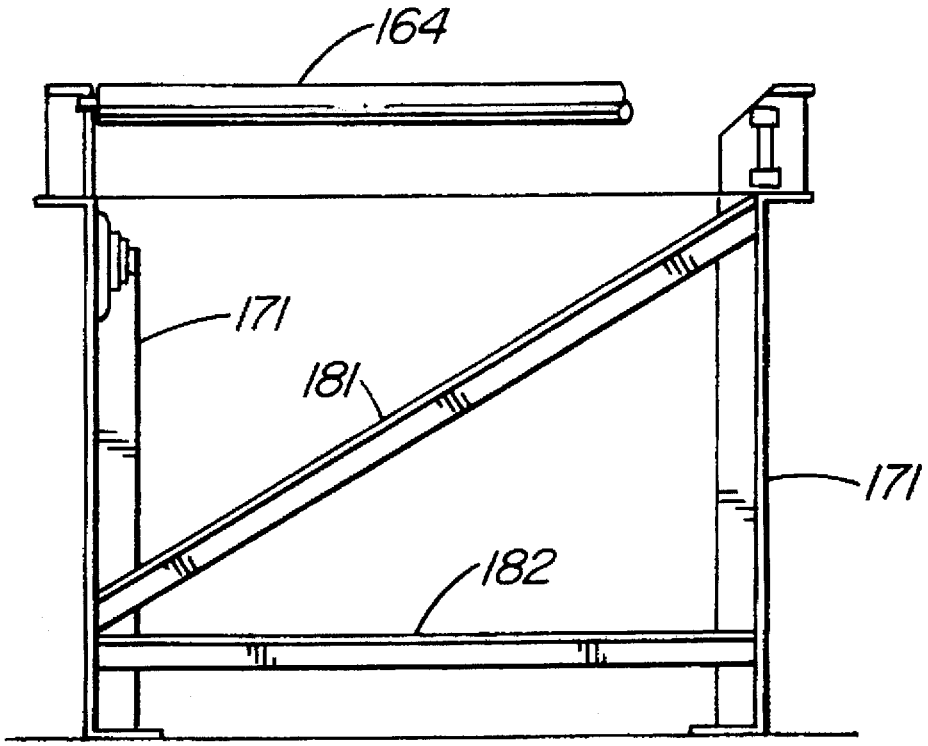

The panel 154 enters the area of the curing table 160 (FIG. 13A) where the glue and the paper surrounding the fiber of the panel 154 complete the bonding and cooling.

Curing table 160 is long as viewed in FIG. 1B and it is designed to be of a length that will allow the paper and glue on the panel to become bonded together depending upon the speed of the panel on the curing table 160 which is determined by the reciprocating speed of the ram head 52. To assist the transport of the curing table when the panel forming apparatus 10 is moved to a new location or is stored, the curing table 160 is collapsible and can be broken apart in sections. A typical section 161 (FIG. 13B) comprises two longitudinal channels 162, 163 with a plurality of rollers 164 which support the panel 154 and allow it to advance on the top of the channels 162, 163 as viewed in FIGS. 13A and 13B.

Each section 161 is connected to adjacent sections by connected plates 170 which can be disconnected and the units 161 separated for transport or storage. A plurality of legs 171, one pair for each section 161, is connected to the channels 162, 163 with a pair of bolts 172, and extend downwardly to contact the foundation 173 on which the curing table is mounted. A leg brace 174, one for each leg 171, extends diagonally downwardly from each channel 162 and connects with leg 171 when the curing table 160 is in its operating position. The brace 174 can likewise be removed from each leg 171 when it is intended to disassemble and transport the curing table 160. A diagonal brace 180 (FIG. 13B) is connected between the two channels 162, 173 as illustrated. Brace 181, 182 extend between the legs 171 as illustrated. They maintain their position when the legs 171 are folded into transport position.

Figure 14A:
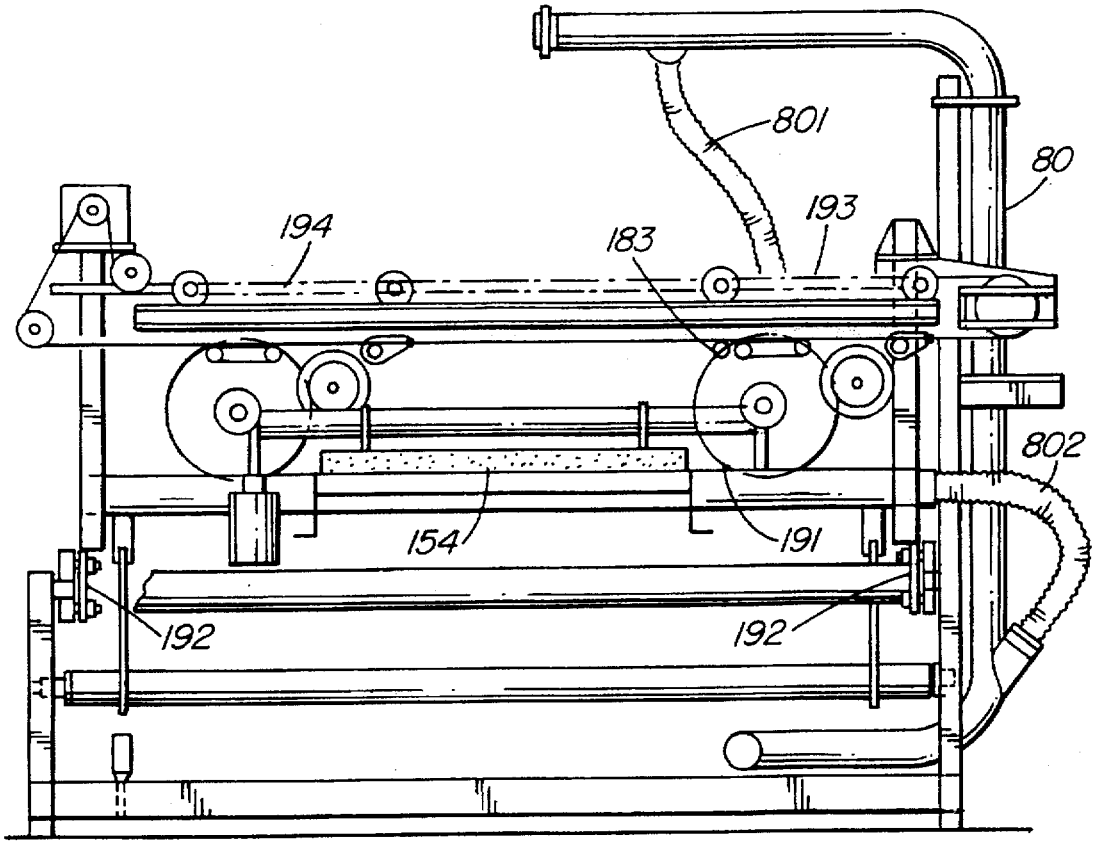
FIGS. 14A, 14B and 14C are end, side and side views, respectively, of the sizing cut-off saw and the drive clamping apparatus illustrating the movement of the saw during operation according to the invention.
Figure 14B:
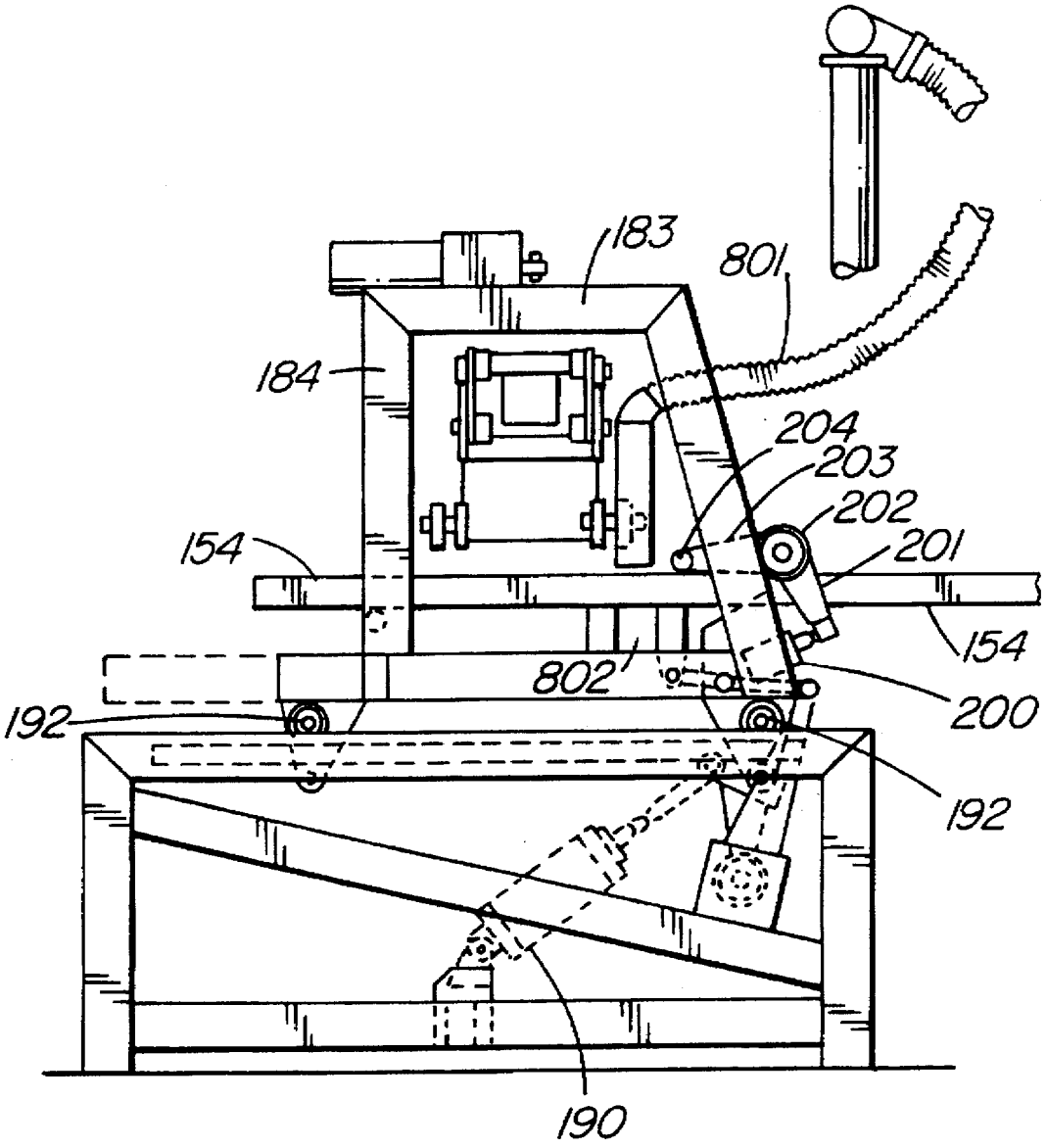

The sizing or cutoff saw 183 (FIG. 14A and 14B) moves with the flow of panels, the flow being illustrated "F" in FIG. 14B. The cutoff saw 183 moves on a frame 184 which moves under the influence of the fiber panel 154 and is assisted by a pneumatic cylinder 190 on rollers 192 to match the flow of fiber panels. The circular saw 191 moves transversely to the flow as is illustrated in FIG. 14A. Circular saw 191 is mounted on a carriage or trolley 193. The carriage 193 cuts the panel to the desired length with one pass through the panel as illustrated in FIG. 14A. When the single pass is complete, the sizing saw assembly 184 has moved to position 194 from position 193. When the next cut is made through the fiber, the carriage with saw 184 moves from its position 194 back to position 193 as illustrated in FIG. 14A.

Figure 14C:
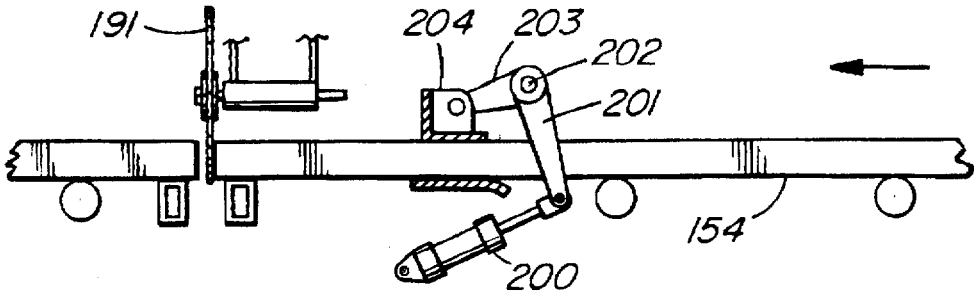

Reference is made to FIG. 14C where a clamping system apparatus 516 engages the fiber panel 154 and is mounted within frame 184. A pneumatic cylinder 200 extends between the frame and an arm 201 which is rotatable about axis 202. Arm 203 is connected to a clamping plate 204 which contacts the panel. The frame 184, therefore, will be carried along with the panel until the press 204 is released after the cutting operation.

Figure 15A:
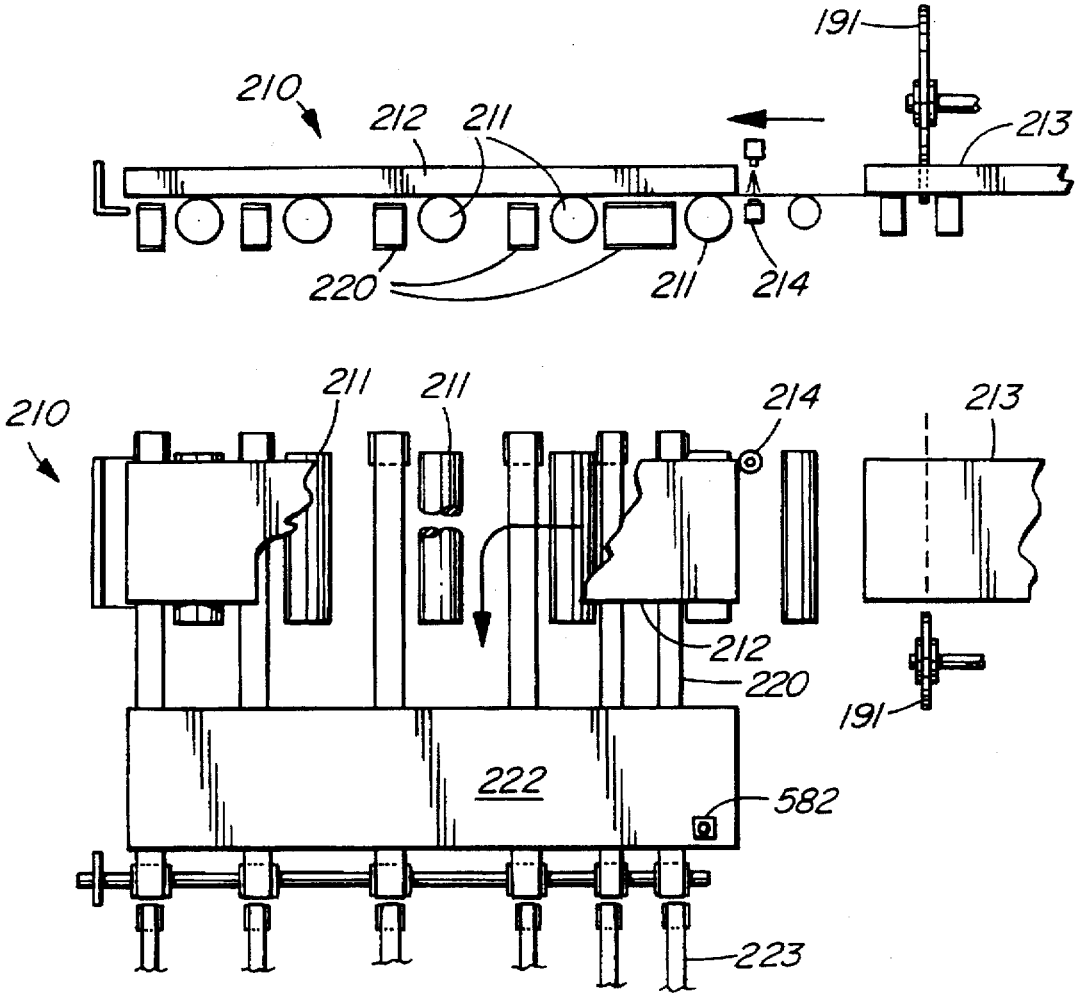
FIGS. 15A and 15B are diagrammatic views of the outfeed station particularly illustrating the transfer belts and outfeed rolls.
Figure 15B:
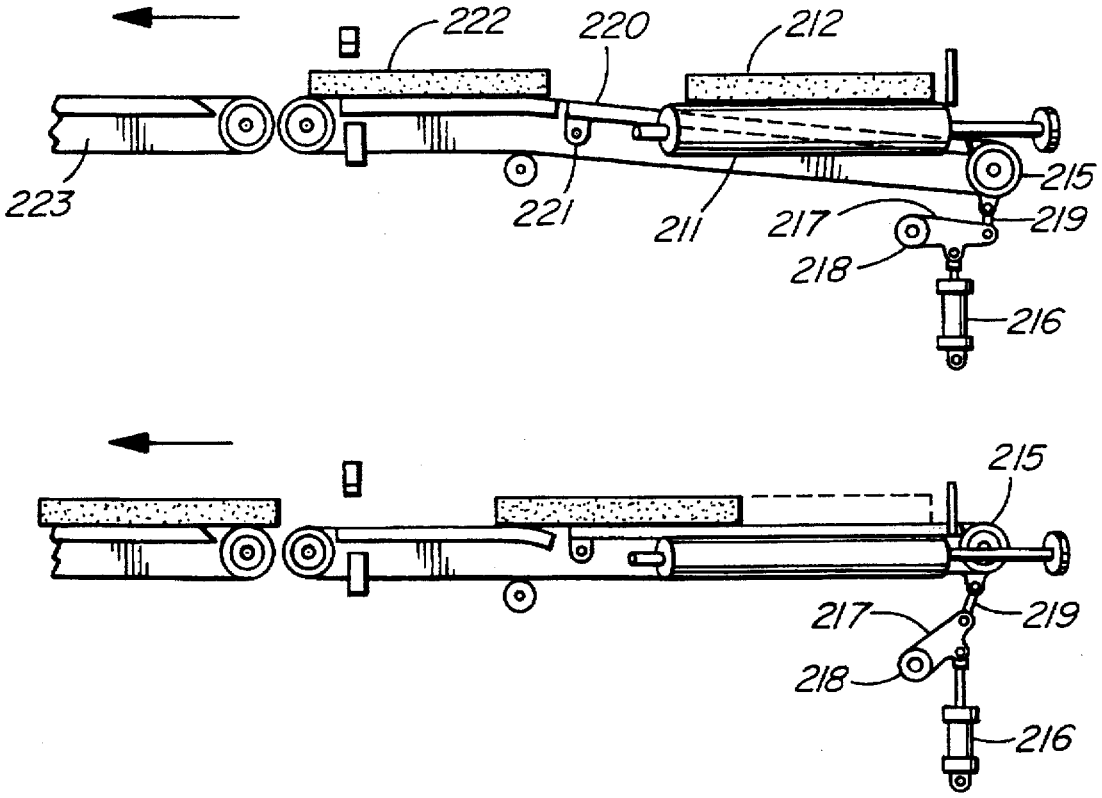

With reference to the outfeed area 210 (FIG. 1B), a plurality of driven outfeed rollers 211 (FIGS. 15A and 15B) will separate the severed panel member 212 by being driven more quickly than the uncut panel 213 which is being driven by the ram head 52 (FIG. 3). Thus, the panel 212 will separate from the uncut panel 213 and pass a photoelectric sensor 214. The transfer belts 220 will rise and move the panel 212 ninety degrees and at right angles to the direction of the curing area as illustrated in FIGS. 15A and 15B. This moves the sized panel 212 off to the side to position 222 and out of the way of oncoming panel 213 from the sizing saw. The transfer belt recedes after panel 212 has cleared. The roll case 211 is now clear to receive the next panel 212 (FIG. 15B).

The lift mechanism of transfer belt 220 operates in the following sequence (FIG. 15B). When the fiber panel 212 passes the photo-electric sensor 214, it activates pneumatic cylinder 216 which raises the end portion 215 of transfer belt 220, by pivoting it about axis 221. The cylinder 216 acts through crank 217 that rotates about axis 218 and connects to the transfer belt through linkage 219.

When the fiber panel 212 reaches position 222, it passes photoelectric sensor 532 which stops the belt 220.

Figure 16A:
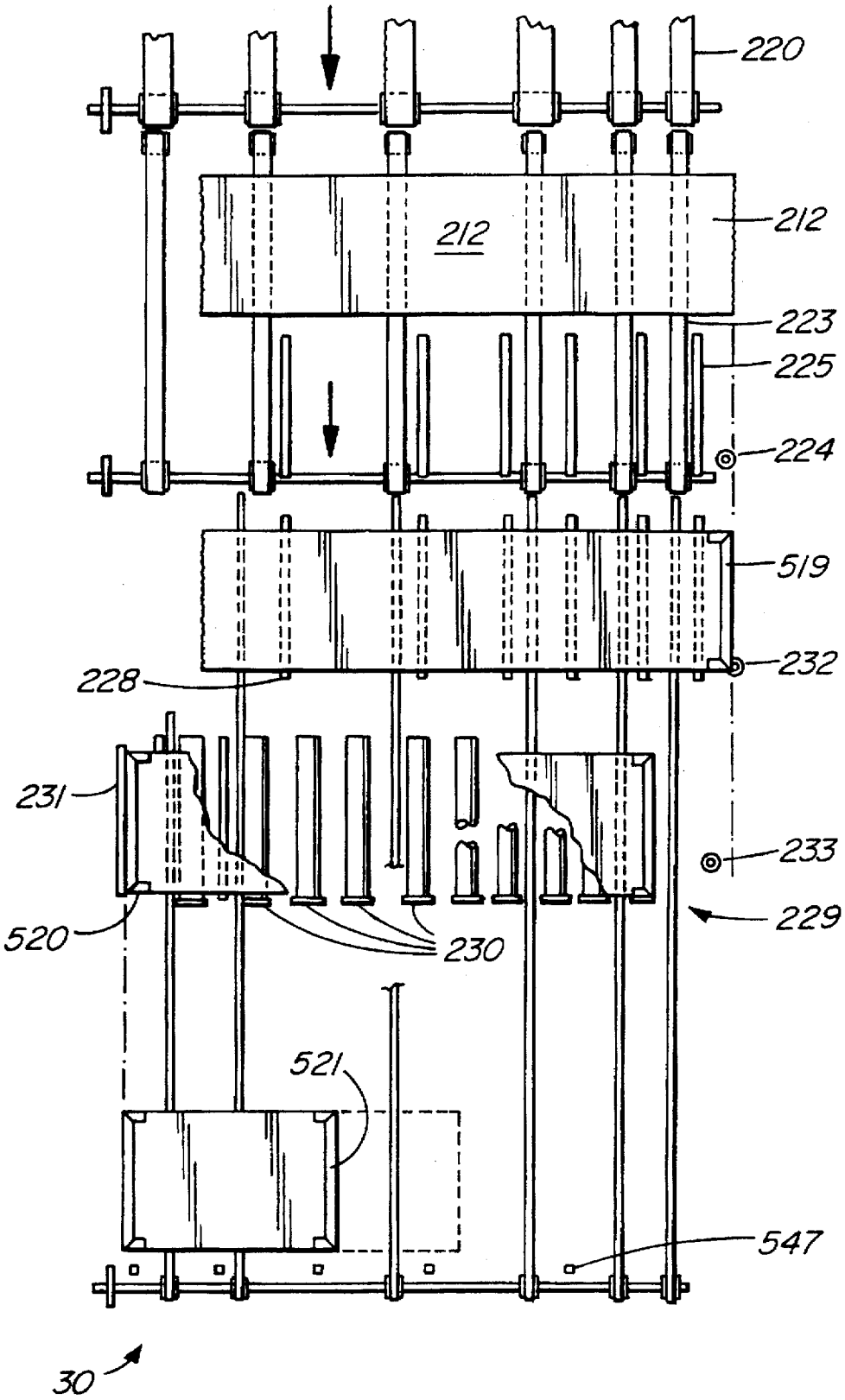
FIGS. 16A, 16B, 16C, 16D and 16E are views of the outfeed station particularly illustrating the end applications to the panel member.

Reference is now made to the finishing area 30 (FIG. 1A) where the fiber panel is completed by enclosing the exposed ends with prepared paper end caps 519, 520 (FIGS. 16A and 6B). When transfer belt 220 begins its next cycle, fiber panel 212 is transferred to continuously operating transfer belt 223. When it passes photo electric sensor 224, skid stops 225 raise and stop the panel from advancing.

Figure 16B:
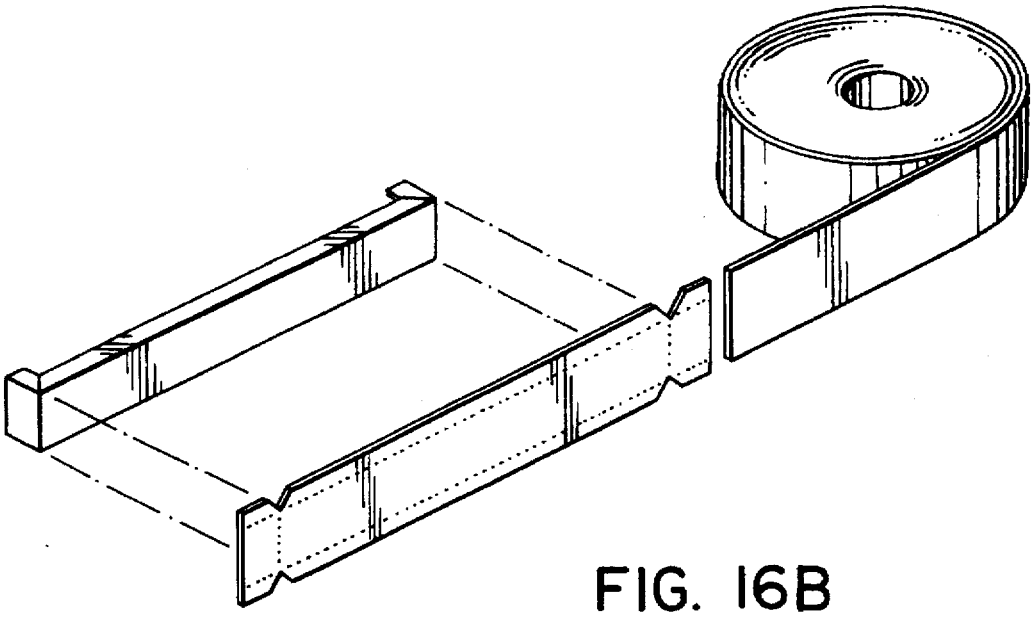
Figure 16C:
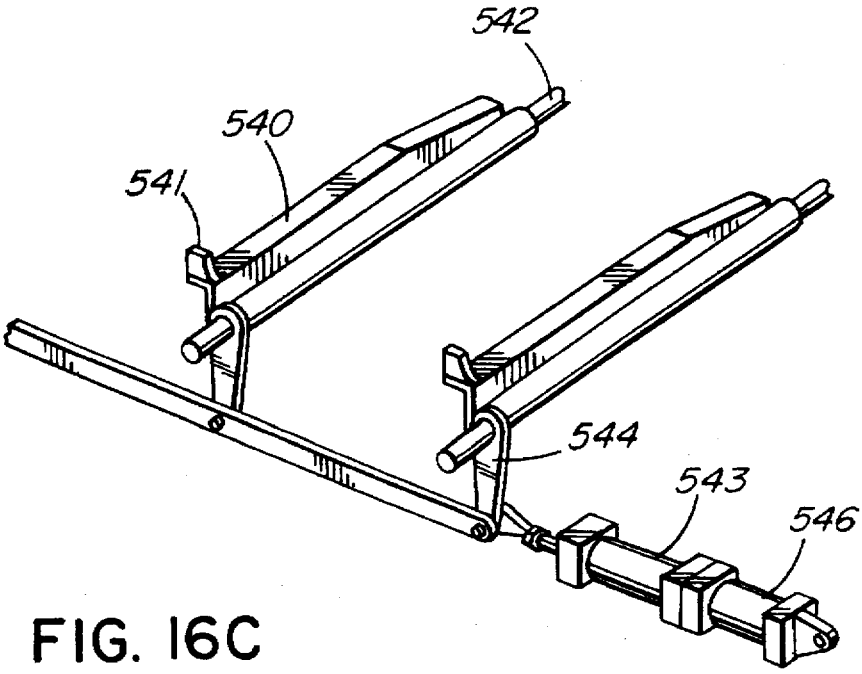
Figure 16D:
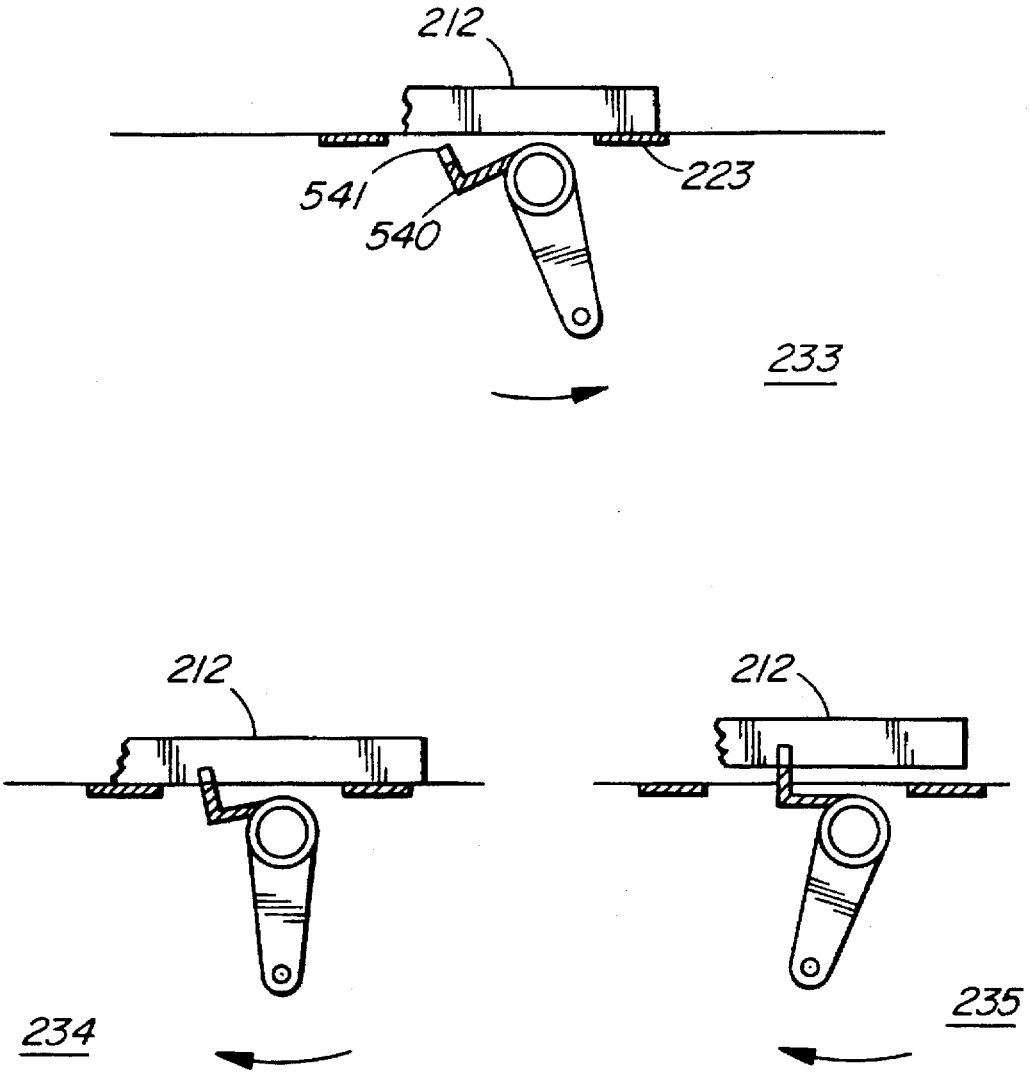
Figure 16E:
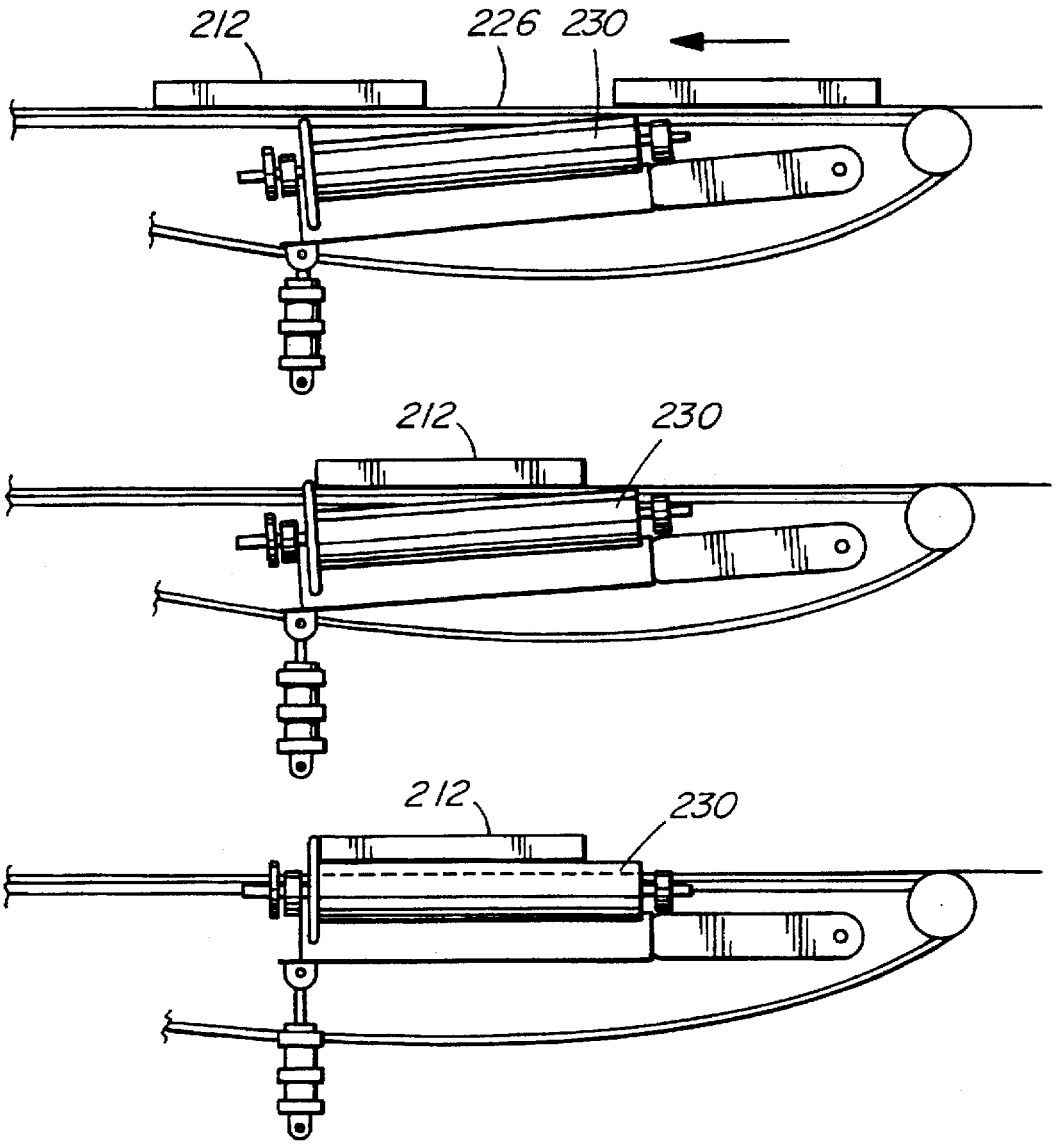

The skid stops 225 (FIG. 16C) consist of a set of bars 540 with end pieces 541 that project upward. The skid stop rotates about axis 542 and is connected to a pneumatic cylinder 543 through crank arm 544. All skid stops are tied together and to the cylinders 543, 546 through a connecting rod 545. The cylinders action rotates the crank 544 about axis 542 raising or lowering the skid stop (FIG. 16D). In the "down" position 233, the panel 212 is resting on transfer belt 223 and is free to advance with the belt. In the intermediate position 234 with cylinder 543 activated only, the end pieces project above the transfer belt 223, stopping the oncoming panel. Through electrical sequencing cylinder 546 is activated raising the skid stop bars 540 to the full up position 235 (FIG. 16D) which lifts the panel off the belt 223. The panel 212 is held in this position until the operator at the first end capping station 227 wishes to advance it. When the operator releases the skid stop 225, the fiber panel moves forward onto roof top transfer chain 226 (FIG. 16E).

When the panel passes photoelectric sensor 232, the skid stop 228 is activated to its intermediate position with the end stop pieces 541 projecting above the transfer chain 226. This stops the fiber panel and indexes it precisely at the first end capping station 227. The skid stops rotate to their full up position 235 and the operator applies the first end cap 519. The end caps 519, 520 are precut and notched paper with heat setting adhesive (FIG. 16B). The operator arranges the paper on the end of the fiber panel and sets it with a hot iron.

Figure 19:
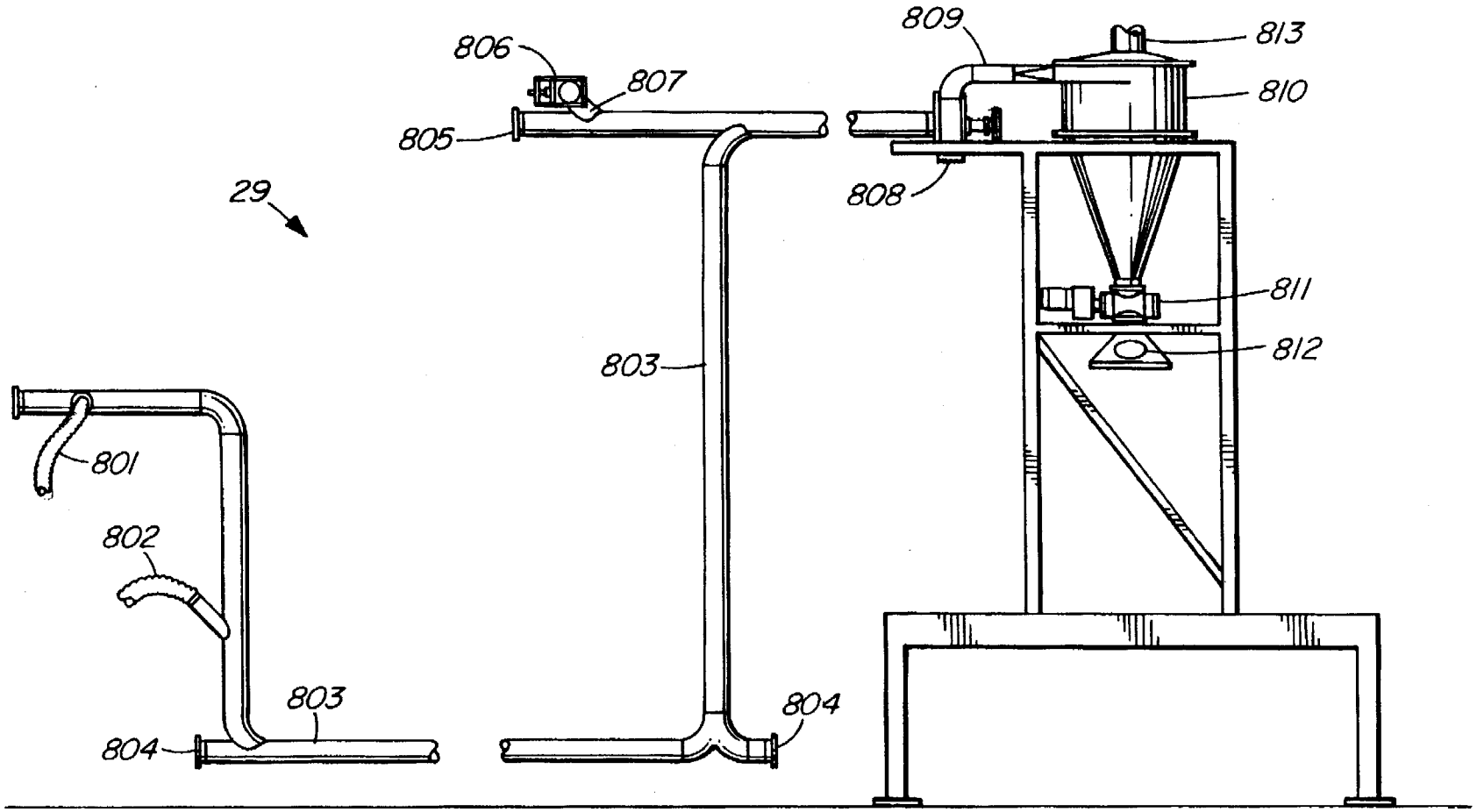
FIG. 19 is a view of the saw dust, dust collecting and re-injection system according to the invention.

The skid stops 228 are then released allowing the fiber panel to advance to the second end capping station 229. The panel passes photoelectric sensor 233 which activates the raising of flanged roll case rolls or transfer rolls 230. This raises the roll case 230 to its intermediate position with the flanges 236 projecting above the transfer chains 226 (FIG. 16E). This stops and indexes the fiber panel 212 for the second end capping station 229. Reference is made to the vacuum system 29 (FIG. 19). Sawdust from cutoff saw 191 is collected by sawdust pickup 801 above the saw and the saw slot pickup 802 below the saw. It is sucked into the pipeline 803 by the vacuum generated by blower 808. Removable end caps 804 are provided so that residue accumulating around the machinery may be cleaned up and disposed of in the vacuum system. To neutralize the air pressure in the feeder 13 generated by the blower 42 of the debailer/shredder, a negative pressure line 807 provides piping between the feeder and blower 808. The degree of negative pressure is controlled by opening adjusted by the negative pressure regulator gate 806 and the free air cap and opening plate 805.

The blower 809 exhausts the collected particles in the air stream through pipe 809 into the dust collector 810. The dust collector 810 centrifugally separates particulate matter from the conveying air, allowing the air to escape through exhaust opening 813 while the dust particles settle to the bottom. The dust is discharged through air lock 811 and down discharge spout 812 where it is recycled to the debailer cylinder 32.

Through electrical sequencing the transfer roll case 230 raises to its full up position, lifting the panel off of the transfer chain 226, and moves the panel endwards into a stop bumper 231 at the second end capping station. Upon contacting the bumper, the roll case 230 stops, the operator applies the second end cap 520 as was done at the first end capping station 227.

Figure 17:
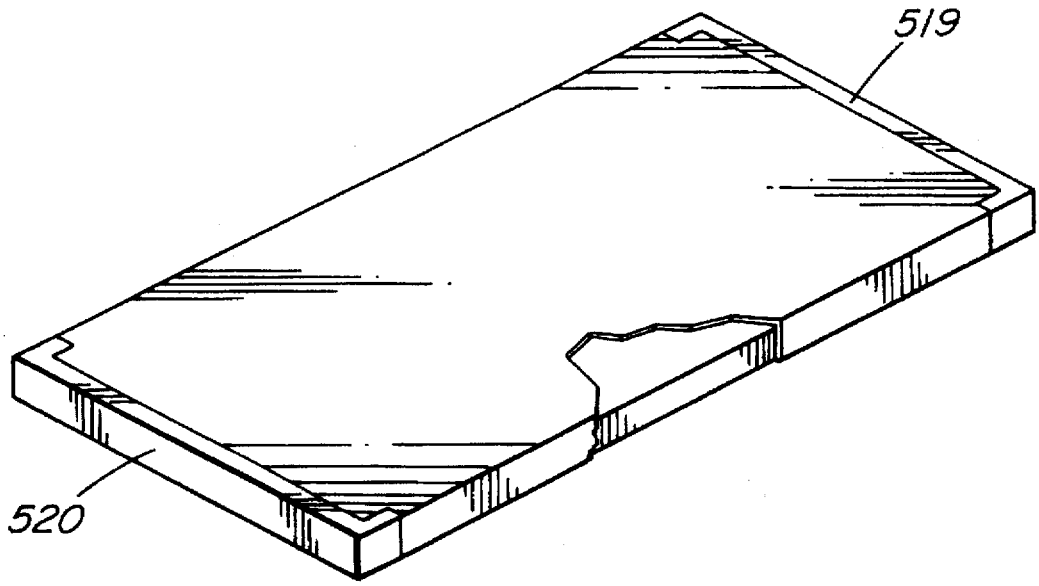
FIG. 17 is an isometric view of a fiber panel produced according to the invention.

The operator will lower the roll case 230 allowing the transfer chain to carry the finished panel 521 to the stop bars 547 at the end of the finish line. Here the finished panel 521 is removed for storage stacking or prepared for shipping. A finished panel (one length only) is illustrated in FIG. 17.

OPERATION

In operation, the straw or other fiber like crop will be bailed into round or rectangular bales as is known.

The individual bale (not illustrated) is introduced to the debailer 31 (FIG. 10) where it rotates within rotary cylinder 32. The cutting knives 34 are adjustable and cut the fiber into shorter or longer lengths as desired as the cylinder 32 rotates.

The fiber pieces drop to chamber 40 and are conveyed by air pressure up conveyor duct 44 (FIG. 1B and 2A) to the wig wag 43 (FIG. 2B) where the fiber is distributed evenly into four augers 50 which even the flow of fiber material and force it within the chamber 57 on top of the ram head 52. Ram head 52 reciprocates within the slot formed by the shear 81 and lower platen 55 and applies pressure to the fiber which is alternatively pushed forwardly between the slot formed by the upper and lower plates 55, 56.

Each return movement of the ram head 52 will allow more fiber from chamber 57 to enter the slot ahead of the ram 52 whereby it will be forced between shear 81 and plate 55 above and plate 56 below, and then into the space between platens 110, 111. The platens 110, 111 are adjusted so as to cause resistance to the advancing fiber which forms it into a uniform densely compacted fiber panel 154.

As the fiber proceeds through the platens 505, 506, paper from the lower paper rolls 124, 125 will pass through the glue applicator roll 133 and contact the panel (FIG. 1B) on the top and bottom surface. The paper extending widthwise a greater distance than the width of the panel will be turned down and up by the action of the helical bar pieces 152, 153 (FIG. 12A) in the envelope forming area 21 (FIG. 1B).

The panel proceeds to the curing table 160 (FIG. 13A) which is of a length sufficient to allow the paper and glue to bond and, thence, the panel enters the sizing saw section 24 where it is cut to its desired length through the action of the saw 191, the frame 184 and the carriage assembly 193 (FIG. 14A) as has been described.

The panel member 212 then travels to the outfeed area 210 (FIG. 1B) where the ends of the envelope surround the panel 212 are closed by adding paper end caps 519, 520 also as has been described. The panel is ready for shipment or other operations as desired (FIG. 16A).

While specific embodiments of the invention have been described, many modifications will readily occur to those skilled in the art to which the invention relates. The description, therefore, should be considered as illustrative of the invention only and not as limiting its scope as defined in accordance with the accompanying claims.

What is claimed is:

1. Apparatus to form a panel from fibrous material comprising a debailer/shredder, said debailer/shredder having a rotary cylinder, a plurality of tools in the bottom of said cylinder to remove fibers of a pre-determined length from a bale placed in said cylinder while said cylinder is rotating, a collector chamber located beneath said rotary cylinder to collect said fiber removed from said bale and a transporter to transport said fiber to a fiber distribution section, said fiber being uniformly distributed by a fiber feeding member to fiber distributing members within said fiber distribution section, said fiber feeding members being located upstream of said fiber distributing members.

2. Apparatus as in claim 1 wherein said transporter is a pneumatic conveyor.

3. Apparatus as in claim 2 wherein said fiber distribution members are a plurality of augers and said fiber feeding member is a reciprocal chute.

4. Apparatus as in claim 3 wherein said plurality of augers feed said fiber into a chamber position below said augers.

5. Apparatus as in claim 4 wherein said fiber in said chamber is compressed into a generally rectangular panel between platen members.

6. Apparatus as in claim 5 wherein said fiber is compressed by a reciprocating ram, said ram being connected to a rotating crank throw, said crank throw including a counterweight positioned on said crank, said ram moving between an extended position wherein said fiber is compressed and moved into the area between said platen members and a retracted position wherein said ram is withdrawn from said area between said platen members.

7. Apparatus as in claim 6 wherein said chamber further includes a shear member, said shear member being operable to sever said fiber in said chamber adjacent the entranceway to said platen members.

8. Apparatus as in claim 5 wherein said platen members are located a predetermined distance apart, said distance being adjustable.

9. Apparatus as in claim 7 wherein said shear member is rotatable about an axis, said shear member including a second hinged arm operably connected between said shear member and a second axis, said hinged arm being collapsible upon a predetermined force being exceeded by said fiber on said shear member.

10. Apparatus as in claim 7 and further including at least one paper roll mounted adjacent to said platen members with the axis of said paper roll being transverse to the longitudinal axis of said area between said platen members.

11. Apparatus as in claim 10 and further including an applicator to apply glue on said paper to said fiber on said top and bottom surfaces of said compressed fiber and extending beyond the width on both sides of said panel member.

12. Apparatus as in claim 11 and further including helical bars to contact said paper extending beyond said width of said fiber within said platen members, said helical bars acting to fold said paper into contact with said fiber on the opposite sides of said fiber moving within said platen members.

13. Apparatus as in claim 12 and further comprising a curing table, said table having at least one leg assembly extending downwardly to provide support for said table, said leg being retractable relative to said curing table.

14. Apparatus as in claim 13 further comprising a cutting section, said cutting section including a cutting saw to cut said fiber, said saw moving transversely relative to said fiber and longitudinally at a longitudinal speed with said fiber, said longitudinal speed during said cutting operation being substantially identical to the longitudinal speed of said fiber.

15. Apparatus as in claim 14 wherein said cutting saw cuts said fiber transversely in one direction between an originating position on one side of said fiber and an end position on the other side of said fiber.

16. Apparatus as in claim 15 wherein said cutting saw cuts said fiber transversely in a second direction between said end position on said other side of said fiber and an originating position on said one end of said fiber.

17. Apparatus as in claim 16 and further including an outfeed table mounted adjacent the end of said cutting section, said outfeed table including a plurality of driven rollers and a transfer table having multiple belts operably mounted transversely relative to said plurality of rollers, said transfer belt cycling vertically relative to said roll case.

* * * * *